US009412257B2

(12) United States Patent
Tajima et al.

(10) Patent No.: US 9,412,257 B2
(45) Date of Patent: Aug. 9, 2016

(54) ELECTRONIC CASSETTE MANAGEMENT SYSTEM, METHOD OF OPERATING ELECTRONIC CASSETTE MANAGEMENT SYSTEM, AND ELECTRONIC CASSETTE MANAGEMENT DEVICE

(71) Applicant: FUJIFILM Corporation, Tokyo (JP)

(72) Inventors: Takashi Tajima, Ashigarakami-gun (JP); Jun Enomoto, Ashigarakami-gun (JP); Takeshi Kuwabara, Ashigarakami-gun (JP); Yasufumi Oda, Ashigarakami-gun (JP); Syo Shimizukawa, Ashigarakami-gun (JP); Fumito Nariyuki, Ashigarakami-gun (JP); Hiroaki Yasuda, Ashigarakami-gun (JP); Haruyasu Nakatsugawa, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/642,912

(22) Filed: Mar. 10, 2015

(65) Prior Publication Data

US 2015/0279196 A1 Oct. 1, 2015

(30) Foreign Application Priority Data

Mar. 26, 2014 (JP) ..... 2014-063998

(51) Int. Cl.

| | |
|---|---|
| ***G08B 1/08*** | (2006.01) |
| ***G08B 21/24*** | (2006.01) |
| ***G08B 13/22*** | (2006.01) |
| ***G08B 13/24*** | (2006.01) |

(52) U.S. Cl.
CPC ..... *G08B 21/24* (2013.01); *G08B 13/22* (2013.01); *G08B 13/24* (2013.01)

(58) Field of Classification Search
None
See application file for complete search history.

(56) References Cited

U.S. PATENT DOCUMENTS

| | | | | |
|---|---|---|---|---|
| 8,425,312 | B1 * | 4/2013 | Kirsch | A63F 1/18 463/12 |
| 2010/0013657 | A1 * | 1/2010 | Ohta | A61B 6/00 340/687 |
| 2010/0061616 | A1 * | 3/2010 | Tsubota | A61B 6/00 382/132 |

FOREIGN PATENT DOCUMENTS

JP 2011-120813 A 6/2011

* cited by examiner

*Primary Examiner* — Travis Hunnings
(74) *Attorney, Agent, or Firm* — Birch, Stewart, Kolasch & Birch, LLP

(57) ABSTRACT

A first data taking section takes first detection results from a first wireless tag reader which detects the come and go of an electronic cassette into and out of a first service zone, and also takes second detection results from a second wireless tag reader which detects the come and go of an electronic cassette into and out of a second service zone. A first alert controller drives a first speaker to start an alert when the first alert controller determines on the basis of the first detection results that the electronic cassette has gone out the first service zone. After the start of alerting, the first alert controller stops driving the first speaker to interrupt the alert when first alert controller determines that the electronic cassette has come in either the first service zone or the second service zone.

16 Claims, 27 Drawing Sheets

30

| CASSETTE ID | NAME |
|---|---|
| DR001 | CASSETTE A (ELECTRONIC CASSETTE 15A) |
| DR002 | CASSETTE B (ELECTRONIC CASSETTE 15B) |
| DR003 | CASSETTE C (ELECTRONIC CASSETTE 15C) |
| DR004 | CASSETTE D (ELECTRONIC CASSETTE 15D) |

FIG.14

92

| CASSETTE ID | NAME | CURRENT POSITION |
|---|---|---|
| DR001 | CASSETTE A (ELECTRONIC CASSETTE 15A) | FIRST RADIOGRAPHY ROOM (FIRST SERVICE ZONE) |
| DR002 | CASSETTE B (ELECTRONIC CASSETTE 15B) | SECOND RADIOGRAPHY ROOM (SECOND SERVICE ZONE) |
| DR003 | CASSETTE C (ELECTRONIC CASSETTE 15C) | THIRD RADIOGRAPHY ROOM (THIRD ERVICE ZONE) |
| DR004 | CASSETTE D (ELECTRONIC CASSETTE 15D) | ROUND-VISIT VEHICLE (FOURTH SERVICE ZONE) |

95

FIG.16

| CASSETTE ID | NAME | CURRENT POSITION | TRACKING RECORD | |
|---|---|---|---|---|
| | | | FORMER POSITION | DATE & TIME |
| DR001 | CASSETTE A (ELECTRONIC CASSETTE 15A) | FIRST RADIOGRAPHY ROOM (FIRST SERVICE ZONE) | ROUND-VISIT VEHICLE (FOURTH SERVICE ZONE) | 2014.3.14 10:05 |
| | | | SECOND RADIOGRAPHY ROOM (SECOND SERVICE ZONE) | 2014.3.14 09:00 |
| | | | FIRST RADIOGRAPHY ROOM (FIRST SERVICE ZONE) | 2014.3.12 14:20 |
| | | | ROUND-VISIT VEHICLE (FOURTH SERVICE ZONE) | 2014.3.12 11:06 |
| DR002 | CASSETTE B (ELECTRONIC CASSETTE 15B) | SECOND RADIOGRAPHY ROOM (SECOND SERVICE ZONE) | THIRD RADIOGRAPHY ROOM (THIRD SERVICE ZONE) | 2014.3.14 15:41 |
| | | | FIRST RADIOGRAPHY ROOM (FIRST SERVICE ZONE) | 2014.3.14 09:05 |
| | | | SECOND RADIOGRAPHY ROOM (SECOND SERVICE ZONE) | 2014.3.12 14:25 |
| | | | FIRST RADIOGRAPHY ROOM (FIRST SERVICE ZONE) | 2014.3.11 10:38 |
| ⋮ | ⋮ | ⋮ | ⋮ | ⋮ |

FIG.20

106

| CASSETTE ID | NAME | HOME POSITION | CURRENT POSITION | TRACKING RECORD | |
|---|---|---|---|---|---|
| | | | | FORMER POSITION | DATE & TIME |
| DR001 | CASSETTE A (ELECTRONIC CASSETTE15A) | FIRST RADIOGRAPHY ROOM (FIRST SERVICE ZONE) | FIRST RADIOGRAPHY ROOM (FIRST SERVICE ZONE) | ROUND-VISIT VEHICLE (FOURTH SERVICE ZONE) | 2014.3.14 10:05 |
| | | | | | |
| | | | | | |
| | | | | | |
| DR002 | CASSETTE B (ELECTRONIC CASSETTE15B) | SECOND RADIOGRAPHY ROOM (SECOND SERVICE ZONE) | ROUND-VISIT VEHICLE (FOURTH SERVICE ZONE) | THIRD RADIOGRAPHY ROOM (THIRD SERVICE ZONE) | 2014.3.14 15:41 |
| | | | | FIRST RADIOGRAPHY ROOM (FIRST SERVICE ZONE) | 2014.3.14 09:05 |
| | | | | THIRD RADIOGRAPHY ROOM (THIRD SERVICE ZONE) | 2014.3.12 14:25 |
| | | | | ROUND-VISIT VEHICLE (FOURTH SERVICE ZONE) | 2014.3.11 10:38 |
| DR003 | CASSETTE C (ELECTRONIC CASSETTE15C) | THIRD RADIOGRAPHY ROOM (THIRD SERVICE ZONE) | THIRD RADIOGRAPHY ROOM (THIRD SERVICE ZONE) | ⋮ | ⋮ |
| DR004 | CASSETTE D (ELECTRONIC CASSETTE15D) | ROUND-VISIT VEHICLE (FOURTH SERVICE ZONE) | SECOND RADIOGRAPHY ROOM (SECOND SERVICE ZONE) | ⋮ | ⋮ |

FIG.21

107

| CASSETTE ID | NAME | LOCATION | FREQUENCY |
|---|---|---|---|
| DR001 | CASSETTE A (ELECTRONIC CASSETTE15A) | FIRST RADIOGRAPHY ROOM (FIRST SERVICE ZONE) | 12 |
| | | SECOND RADIOGRAPHY ROOM (SECOND SERVICE ZONE) | 3 |
| | | THIRD RADIOGRAPHY ROOM (THIRD SERVICE ZONE) | 8 |
| | | ROUND-VISIT VEHICLE (FOURTH SERVICE ZONE) | 16 |
| DR002 | CASSETTE B (ELECTRONIC CASSETTE15B) | FIRST RADIOGRAPHY ROOM (FIRST SERVICE ZONE) | 6 |
| | | SECOND RADIOGRAPHY ROOM (SECOND SERVICE ZONE) | 22 |
| | | THIRD RADIOGRAPHY ROOM (THIRD SERVICE ZONE) | 4 |
| | | ROUND-VISIT VEHICLE (FOURTH SERVICE ZONE) | 13 |
| ⋮ | ⋮ | ⋮ | ⋮ |

116

| OPERATIONAL CONDITION | RANGE OF SERVICE ZONE |
|---|---|
| NON-SELECTED | 5m |
| SELECTED | 2m |

FIG.28

117

| OPERATIONAL CONDITION | RANGE OF SERVICE ZONE |
|---|---|
| POWER OFF | 5m |
| SLEEP | 3m |
| STANDBY | 2m |
| READY | 1m |

ELECTRONIC CASSETTE MANAGEMENT SYSTEM, METHOD OF OPERATING ELECTRONIC CASSETTE MANAGEMENT SYSTEM, AND ELECTRONIC CASSETTE MANAGEMENT DEVICE

CROSS-REFERENCE TO RELATED APPLICATIONS

The present application claims priority under 35 U.S.C. §119 to Japanese Patent Application No. 2014-063998, filed Mar. 26, 2014. Each of the above application(s) is hereby expressly incorporated by reference, in its entirety, into the present application.

BACKGROUND OF THE INVENTION

1. Field of the Invention

The present invention relates to an electronic cassette management system, a method of operating the electronic cassette management system, and an electronic cassette management device.

2. Description Related to the Prior Art

An electronic cassette is known as an X-ray image detector that detects an X-ray image while receiving radioactive rays, e.g. X-rays. The electronic cassette has a structure wherein a sensor panel for converting incident X-rays to an electric signal is contained in a transportable housing. Some electronic cassettes are equipped with a function for wireless communication, wherein a battery and a wireless communicator are integrated within the housing to allow wireless transmission of the X-ray image and other data.

Japanese Laid-open Patent Application No. 2011-120813 discloses a round-visit vehicle for X-ray imaging in a patient bedroom during the ward-round, wherein an X-ray source for projecting X-rays toward an imaging subject (a patient) and a console for operating an electronic cassette, which is equipped with function for wireless communication, are boarded on a mobile wagon. The round-visit vehicle is provided with a container box for containing the electronic cassette.

The above-mentioned round-visit vehicle is equipped with a function for preventing misplacement of the electronic cassette in the patient bedroom. The function preventive against the misplacement is constituted of a detector for detecting whether or not the electronic cassette is contained in the container box while the imaging is not being conducted, and an alerting section, such as a display panel or a speaker, for warning that the electronic cassette is not contained in the container box when the detector detects that the electronic cassette is not contained in the container box.

The detector monitors the state of wireless communication between the electronic cassette and the console, and detects that the electronic cassette is not contained in the container box when the electronic cassette is apart such a distance from the round-visit vehicle that the wireless communication between the electronic cassette and the console gets impossible. The alerting section stops alerting when the electronic cassette is contained in the container box.

Because electronic cassettes are relatively expensive, even a medical facility that has multiple radiography rooms and multiple round-visit vehicles is not always equipped with a sufficient number of electronic cassettes as compared to the number of radiography rooms or round-visit vehicles. Therefore, in these medical facilities, electronic cassettes are shared among a plurality of service zones, including radiography rooms and round-visit vehicles. For example, an electronic cassette located in a radiography room may be taken out for use in another radiography room, or an electronic cassette boarded on a round-visit vehicle may also be brought to use in a radiography room.

Due to the mobility and the relative expensiveness of the electronic cassette, it is necessary to use abundance of caution against the theft of the electronic cassette. In the invention disclosed in the above Japanese Laid-open Patent Application No. 2011-120813, when the electronic cassette is apart a certain distance from the console and hence the wireless communication between the electronic cassette and the round-visit vehicle becomes impossible, an alert is given to warn that the electronic cassette is not contained in the container box electronic cassette. Therefore, the alert would be given not only when the electronic cassette is left in a patient bedroom, but also when an unauthorized person takes out the electronic cassette with the intention to steal. Thus, it is possible to prevent the theft of the electronic cassette.

However, if the feature disclosed in the above patent document is applied to the case where an electronic cassette is shared among a plurality of service zones and moved across these service zones, the alert would be given also when an authorized user brings an electronic cassette out from a service zone into another service zone, and the alert would not stop in that case. This would be definitely bothering. It would be possible to provide the electronic cassette with an button to stop the alert or set the alert to stop automatically when a time is over. However, these solutions would disable the preventive effect against the theft because the alert would be interrupted even while the electronic cassette is being improperly taken out.

Thus, in the case where an electronic cassette is moved across a plurality of service zones to share the electronic cassette among these zones, it is required to give a warning when the electronic cassette is taken out of any of the service zones, but if the electronic cassette is taken out of the service zone for the purpose of using the same in another service zone or for other proper purposes or applications, it is necessary to stop the warning at the right time.

SUMMARY OF THE INVENTION

In view of the foregoing, the present invention has an object to provide an electronic cassette management system, a method of operating the electronic cassette management system, and an electronic cassette management device, which make it possible to give an alert when an electronic cassette is taken out of any of a plurality of service zones in a situation where the electronic cassette is shared among and moved across the service zones, but also make it possible to stop the alert appropriately at the right time if the electronic cassette is taken out within a range of proper operations.

In order to achieve the above object of the present invention, an electronic cassette management system in accordance with the present invention comprises first and second detectors, a data taking section, and an alert controller. The first and second detectors detect the come and go of an electronic cassette with respect to at least first and second predetermined service zones. The data taking section takes detection results from the first and second detectors. The alert controller starts an alert when the alert controller determines, on the basis of detection results taken by the data taking section, that the electronic cassette has gone out either of the first and second service zones. The alert controller stops the alert when the alert controller determines, on the basis of detection results taken by the data taking section after the start of alerting, that the electronic cassette has come in either of the first and second service zones.

It is preferable that the electronic cassette management system further comprises a recording controller for recording a current position of the electronic cassette, which is determined by the detection results, in a recording section. The recording controller may record tracking records in the recording section in addition to the current position, tracking records indicating former positions of the electronic cassette, which have been determined by former detection results taken by the data taking section.

It is preferable that the electronic cassette management system further comprises a display controller for displaying at least the current position on a display among the current position and the tracking records.

It is preferable that the electronic cassette management system further comprises a home position setting section for setting up a home position of the electronic cassette. The recording controller may delete at least part of the tracking records when the electronic cassette comes back to the home position that is set up by the home position setting section. The home position setting section may also refer to the tracking records to set up a place as the home position where the electronic cassette is frequently located.

It is preferable that the data taking section, the alert controller and the recording controller are provided in a console that is provided for operating the electronic cassette.

In a situation where one of the service zones is supervised by a plurality of consoles, it is preferable that the electronic cassette management system further comprises an enable/disable setting section for enabling the alert controller and the recording controller in at least one of the plurality of consoles.

In a situation where the plurality of consoles include a portable console that a user of the electronic cassette is carried about, the enable/disable setting section may preferably enable the alert controller and the recording controller of the portable console.

It is preferable that the electronic cassette management system further comprises a range setting section for setting up the range of the service zone according to operational conditions of the electronic cassette. It is preferable that the operational conditions include a non-selected condition in which the electronic cassette is not selected to use for radiography and a selected condition selected to use for radiography, and the range setting section sets the range of the service zone narrower in the selected condition than in the non-selected condition.

It is possible to register a plurality of electronic cassettes as ones to be detected by the detectors.

The detectors are preferably wireless receivers that a receive radio frequency signal from a wireless communicator provided in the electronic cassette.

A method of operating the electronic cassette management system in accordance with the present invention comprises the steps of detecting the come and go of an electronic cassette by first and second detectors with respect to at least first and second predetermined service zones, taking detection results from the first and second detectors, starting an alert when it is determined on the basis of the detection results that the electronic cassette has gone out either of the first and second service zones, and stopping the alert when it is determined that the electronic cassette has come in either of the first and second service zones on the basis of detection results taken from the first and second detectors after the start of alerting.

Furthermore, an electronic cassette management device in accordance with the present invention comprises a first detector for detecting the come and go of an electronic cassette with respect to a predetermined first service zone, a data taking section for taking first detection results from the first detector and second detection results from a second detector for detecting the come and go of the electronic cassette with respect to a second service zone that is assigned to at least another electronic cassette management device, and an alert controller that starts an alert when the alert controller determines, on the basis of the first detection results taken by the data taking section, that the electronic cassette has gone out the first service zone. The alert controller stops the alert when the alert controller determines, on the basis of the first detection results or the second detection results taken by the data taking section, that the electronic cassette has come in the first service zone or the second service zone.

According to the present invention, detection results indicating the come and go of an electronic cassette with respect to at least first and second predetermined service zones are obtained, so that an alert is started when it is determined that the electronic cassette has gone out either of the first and second service zones, and the alert is stopped when it is determined that the electronic cassette has come in either of the first and second service zones after the start of alerting. Therefore, in a situation where an electronic cassette is shared among and moved across a plurality of service zones, the present invention can provide an electronic cassette management system, a method of operating the electronic cassette management system and an electronic cassette management device, which make it possible to give an alert when the electronic cassette is taken out of any of the service zones and also stop the alert at the right time if the electronic cassette is taken out for proper operations.

BRIEF DESCRIPTION OF THE DRAWINGS

The above and other objects of the present invention will be more apparent from the following detailed description of the preferred embodiments when read in connection with the accompanied drawings, wherein like reference numerals designate like or corresponding parts throughout the several views, and wherein:

FIG. 14 is a diagram illustrating a cassette registration table including an item on current positions of electronic cassettes;

FIG. 16 is a diagram illustrating a cassette registration table including items on current positions and tracking records of the electronic cassettes;

FIG. 20 is a diagram illustrating a cassette registration table including an item on home positions of the electronic cassettes;

FIG. 21 is a diagram illustrating a tally table;

FIG. 28 is a diagram illustrating another example of a range setup table.

DESCRIPTION OF THE PREFERRED EMBODIMENTS

First Embodiment

Figure 1:
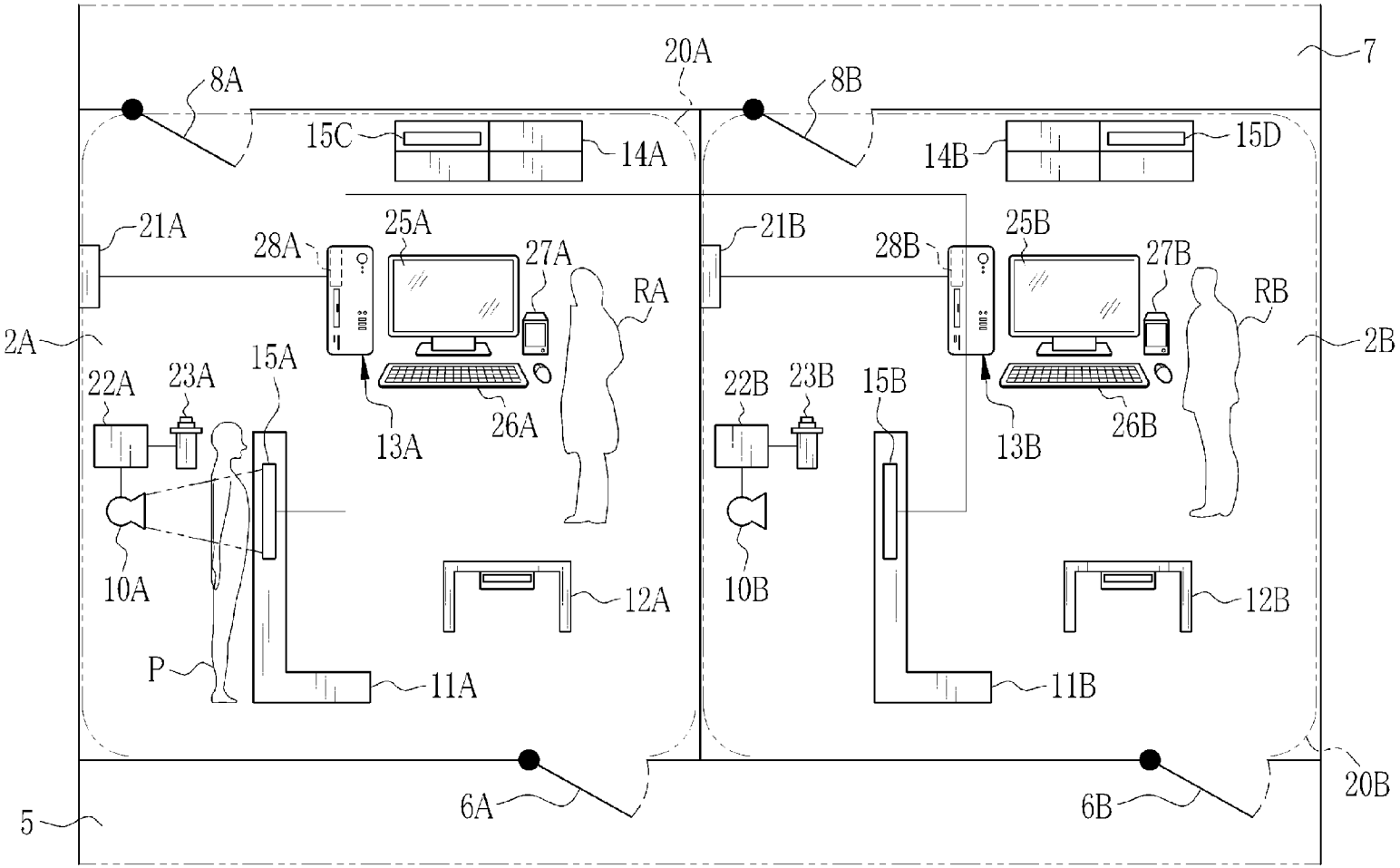
FIG. 1 is a diagram illustrating the interior of a medical facility having first and second radiography rooms.

In FIG. 1, a first radiography room 2A and a second radiography room 2B, which are for X-ray imaging, are located in adjacent to each other in a medical facility. The first radiography room 2A is provided with a first doorway 6A through which a patient P as an imaging subject comes in from a waiting room 5 or goes out to the waiting room 5, and a staff entrance 8A for a first user RA or a second user RB to go to and come from the second radiography room 2B through a passageway 7. The first user RA or the second user RB may be a doctor, a radiologist or a staff who is stationed in the first radiography room 2A or the second radiography room 2B, respectively.

The first radiography room 2A is installed with a first X-ray source 10A for projecting X-rays toward the patient P, a first radiographic stand 11A for use in imaging the patient P in an upright position, a first radiographic table 12A for use in imaging the patient P in a recumbent position, a first console 13A operated by the first user RA, and a first rack 14A. Note that the structure and equipment of the second radiography room 2B are equal to those of the first radiography room 2A, including the first doorway 6A and the first X-ray source 10A, and thus the description of the structure and equipment of the second radiography room 2B will be omitted. In the following explanation, structural elements and devices as for the second radiography room 2B are designated by the same terms and reference numerals as those for the first radiography room 2A and, as needed, differentiated therefrom by putting "second" and "B" at the beginning of each term and at the end of each numeral, respectively, whereas "first" and "A" are put at the beginning of each term and at the end of each numeral, respectively, as for the structural elements and devices of the first radiography room 2A. In case where the differentiation therebetween is unnecessary, "first" and "A" or "second" and "B" will be omitted from the designations and, for example, the wording "X-ray source 10" will be used. The same applies to the first user RA and the second user RB.

The medical facility is equipped with four electronic cassettes 15A, 15B, 15C and 15D. The electronic cassettes 15A to 15D each detect an X-ray image from X-rays received thereon, which have been projected from the X-ray source 10 and penetrated the patient P. In the medical facility, the electronic cassettes 15A to 15D are shared between the radiography rooms 2A and 2B. In this example, among the electronic cassettes 15A to 15D, the electronic cassettes 15A and 15B are of the same type, and the electronic cassette 15A is mainly used in the first radiography room 2A, whereas the electronic cassette 15B is mainly used in the second radiography room 2B. The electronic cassettes 15C and 15D are of a different type.

The same type means that the cassettes are equal in dimensions and features, and the different type means that the cassettes are different in dimensions or features or both. For example, the electronic cassettes 15A and 15B have the same dimensions of 14×17 inches and the same features, whereas the electronic cassette 15C has dimensions of 17×17 inches and the electronic cassette 15D has dimensions of 10×12 inches.

The electronic cassettes 15A and 15B are set in the radiographic stand 11A of the first radiography room 2A and in a radiographic stand 11B of the second radiography room 2B, respectively. In the first radiography room 2A, the X-ray imaging of the patient P is being carried out. The electronic cassette 15C is stored in the first rack 14A of the first radiography room 2A, and the electronic cassette 15D is stored in a second rack 143 of the second radiography room 2B. In spite of the differences in size and features, the electronic cassettes 15A to 15D are equal in the fundamental structure, and therefore are collectively called "the electronic cassettes 15" in case where the differentiation therebetween is unnecessary.

In the radiographic stand 11 or the radiographic table 12, the electronic cassette 15 is held in a posture where a front face 45 thereof (refer to FIG. 4) faces the X-ray source 10. The patient P is positioned by the user R such that, the body site to be imaged is placed in between the X-ray source 10 and the electronic cassette 15. The X-ray source 10 can be set in a desired orientation at a desired location by means of an X-ray source transporting device (not shown), so that the X-ray source 10 may be shared by the radiographic stand 11 and the radiographic table 12. The electronic cassette 15 is also usable independently of the radiographic stand 11 and the radiographic table 12 in such a manner that the electronic cassette 15 is put on a bed on which the patient P lies or the electronic cassette 15 is held by the patient P.

A service zone 20 is predetermined in each radiography room 2. The service zone 20 is a spatial range within which the use of the electronic cassette 15 is permitted. The waiting room 5 and the passageway 7 are excluded from the service zone 20.

The console 13 is connected to a tag reader 21 (corresponding to a wireless receiver unit of the present invention). The wireless tag reader 21 is mounted to a wall, a ceiling or the like of each radiography room 2. The wireless tag reader 21 is driven by a different power supply from that for the console 13, and periodically sends a radio search signal. Responding to the search signal, the wireless tag reader 21 receives a response signal from a wireless tag 50 (corresponding to a wireless transmitter; refer to FIG. 4) of each of those electronic cassettes 15 which are located within the service zone 20 across which the wireless tag reader 21 is searching, to thereby detect passage of the electronic cassettes 15 into and out of said service zone 20. The wireless tag reader 21 thus serves as a detector. The wireless tag 50 is attached to each electronic cassette 15.

The console 13 and the wireless tag reader 21 constitute an electronic cassette management apparatus of the present invention. The first console 13A and the first wireless tag reader (first detector) 21A supervise the come and go of the electronic cassettes 15 into and out of the first service zone 20A that is predetermined within the first radiography room 2A. The second console 13B and the second wireless tag reader (second detector) 21B supervise the come and go of the electronic cassettes 15 into and out of the second service zone 203 that is predetermined within the second radiography room 2B. The first console 13A, the second console 13B, the first wireless tag reader 21A and the second wireless tag reader 21B constitute an electronic cassette management system of the present invention.

So long as the wireless tag reader 21 receives the response signal from the wireless tag 50 of one of the electronic cassettes 15, the wireless tag reader 21 outputs a detection result indicating that the one electronic cassette 15 is present in the supervised service zone 20. Meanwhile, when no response signal is received from one of the electronic cassettes 15, the wireless tag reader 21 outputs a detection result indicating that the one electronic cassette 15 is absent (or brought out) from the supervised service zone 20. Each detection result is attended by a reader ID of the wireless tag reader 21 that outputs the detection result. In addition to the reader ID, the detection result indicating that one electronic cassette 15 is present in the service zone 20 is attended by a cassette ID of the one electronic cassette 15 from which the wireless tag 50 sends the response signal.

The service zone 20 is determined depending upon the signal reach or transmission range of the search signal and the response signal. In this example, a frequency band around 900 MHz (e.g., 868 MHz), so-called UHF (ultra-high frequency) band, is used for the search signal and the response signal, wherein the signal reach thereof is about 2 to 5 meters. In order to discriminate between the respective electronic cassettes 15A to 15D, a different channel is allocated to each of the respective electronic cassettes 15A to 15D for the search signal and the response signal.

The first service zone 20A and the second service zone 20B are determined to cover the entire space in the first radiography room 2A and the entire space in the second radiography room 2B, respectively, and do not overlap each other. Therefore, the search signals and the response signals will not be confused between the radiography rooms 2A and 2B. As a method of determining the first service zone 20A and the second service zone 20B so as to cover the respective entire spaces of the radiography rooms 2A and 2B but not to overlap each other, it is possible to employ a method of electromagnetically shielding the individual radiography rooms 2A and 2B. Note that the wireless tag reader 21 may be attached to the door of the doorway 6 or the staff entrance 8, or a base for disposing the console 13 thereon, etc. The wireless tag reader 21 may also be integrated in the console 13.

The X-ray source 10 has an X-ray tube for radiating X-rays and an irradiation field limiter (that may also be called collimator) for limiting the irradiation field of X-rays from the X-ray tube. The X-ray source 10 is connected to a source controller 22, and an activation switch 23 is connected to the source controller 22. The source controller 22 controls tube voltage applied to the X-ray tube, tube current and X-ray irradiation time. The source controller 22 previously stores a number of kinds of image acquisition settings, including tube voltage, tube current and irradiation time, adjusted to individual body sites to be imaged, such as chest and abdomen, so that the user R can select and input an appropriate one from among the stored settings.

The activation switch 23, which is operated by the user R, may be a two-step push button switch. When the activation switch 23 is pushed to the first step (to the half), the source controller 22 causes the X-ray source 10 to start a preparatory operation for X-ray irradiation. When the activation switch 23 is pushed further to the second step (to the full), the source controller 22 causes the X-ray source 10 to start X-ray irradiation. The source controller 22 has a timer that starts time-counting with the start of X-ray irradiation, to stop the X-ray source 10 from X-ray irradiation when the counted time reaches an irradiation time that is determined according to the image acquisition settings.

The console 13 includes a display device 25, an input device 26, a speaker 27, a storage device 28, etc., and is installed in each radiography room 2. The display device 25 displays a variety of operation menu screens according to the operation through the input device 26, such as a keyboard and a mouse. The operation menu screens are provided with GUI (graphical user interface) through which the console 13 receives inputs of operational instructions from the input device 26.

The display device 25 also displays X-ray images detected through the electronic cassette 15 besides the operation menu screens, such as a screen for inputting imaging conditions. The speaker 27 sounds an alarm when any of the electronic cassettes 15 is moved out of the service zone 20. The storage device 28 may for example be a hard disc drive, and stores the X-ray images and various information necessary for X-ray imaging.

The console 13 receives inputs of examination orders and displays the received orders. Each examination order includes patient information, such as gender and age of the patient P, information on the body site to be imaged, such as head, chest, abdomen, hand or finger, the position in imaging, such as upright or recumbent, and the imaging direction, such as frontal, back or lateral. The examination orders are input by means of external systems (not shown), such as a hospital information system (HIS) and a radiological information system (RIS), which manage patient information and information on radiological examinations.

The storage device 28 stores a number of kinds of image acquisition settings corresponding to respective types of patient information, body sites to be imaged, imaging positions and imaging directions, for example, in the form of a data table. As described above, the image acquisition settings include a tube voltage applied to the X-ray tube, a tube current and an X-ray irradiation time, which are determined taking consideration of the patient information, the body site to be imaged, the imaging position and the imaging direction. The user R checks the content of each examination order on the display device 25 to determine the image acquisition settings according to the content. The determined image acquisition settings are transferred from the console 13 to one electronic cassette 15 used for imaging. The user R sets up the source controller 22 with the same image acquisition settings as in the console 13. In place of a tube current and an irradiation time, the product of the tube current and the radiation time (mAs value) may be input as one of the image acquisition settings.

Figures 2, 3:
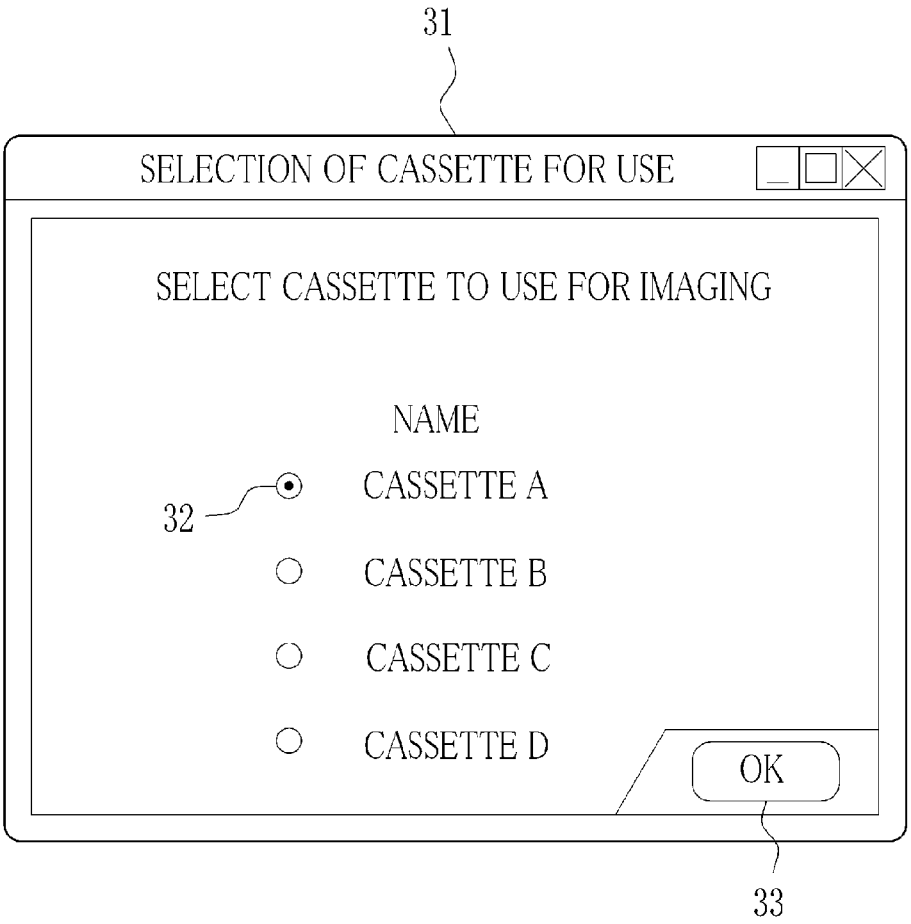
FIG. 2 is a diagram illustrating a cassette registration table.
FIG. 3 is a diagram illustrating a cassette selection window.

Referring to FIG. 2, the storage device 28 stores a cassette registration table 30 for identifying the individual electronic cassettes 15A to 15D, in which the respective cassette IDs and the respective cassette names are registered in combinations. For example, at most five electronic cassettes 15 can be registered in the cassette registration table 30. The cassette IDs are entered in the cassette registration table 30 by reading the wireless tags 50, which are respectively attached to the respective electronic cassettes 15A to 15D, through the wireless tag reader 21 at the registration of the respective electronic cassettes 15A to 15D. The cassette names may be given to the respective electronic cassettes 15A to 15D by the user R. In this example, the electronic cassette 15A, the electronic cassette 15B, the electronic cassette 15C and the electronic cassette 15D are named "Cassette A", "Cassette B", "Cassette C" and "Cassette D", respectively.

When one electronic cassette 15 is selected to use for imaging by operating the input device 26, the console 13 determines which of the respective electronic cassettes 15A to 15D is selected with reference to the cassette ID registered in the cassette registration table 30. Furthermore, the respective electronic cassettes 15A to 15D registered in the cassette registration table 30 are recognized by the wireless tag reader 21 as subjects to monitor.

As shown in FIG. 3, the display device 25 displays a cassette selection window 31 for selecting one electronic cassette 15 to use for imaging from among the electronic cassettes 15A to 15D. The cassette selection window 31 lists the names of the respective electronic cassettes 15A to 15D registered in the cassette registration table 30 and radio buttons 32 are provided beside the cassette names. The radio buttons 32 constitute a GUI which allows to choose only one button and cancels the choice of another button upon one button being chosen, thereby allowing to select only one of the electronic cassettes 15A to 15D. In the illustrated example, the electronic cassette 15A, named Cassette A, is selected. By acting on an OK button 33 after selecting any of the electronic cassettes 15 by the corresponding radio button 32, the selection of the one electronic cassette 15 to use for imaging is complete.

When one electronic cassette 15 has been selected to use for imaging on the cassette selection window 31, the console 13 sends a selection signal, which indicates the selection for imaging (refer to FIG. 6), to the selected one of the electronic cassettes 15A to 15D.

Figure 4:
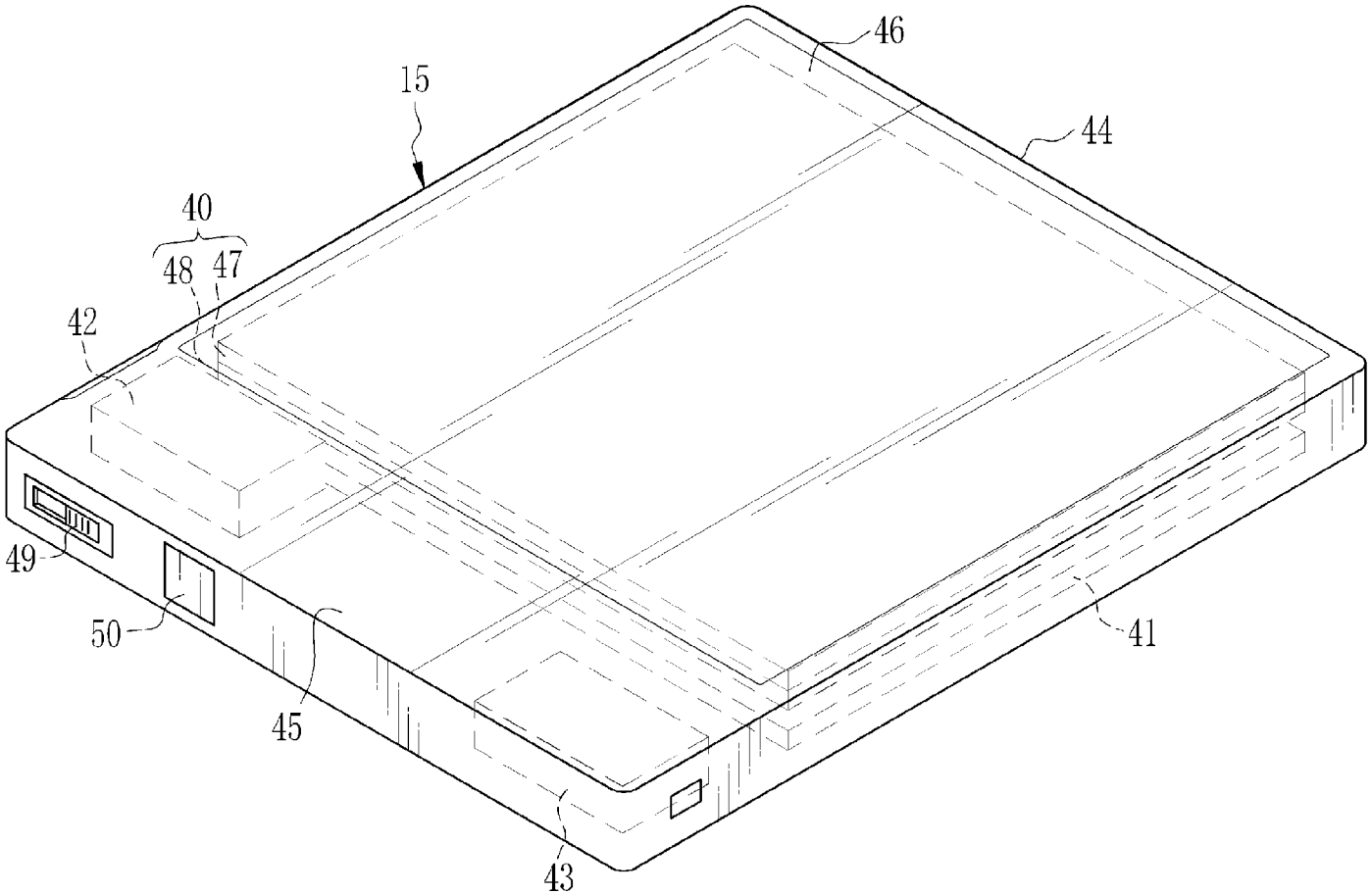
FIG. 4 is a perspective view of an electronic cassette.

In FIG. 4, the electronic cassette 15 has a sensor panel 40, a control circuit board 41, a battery 42, a communicator section 43, and a flat box-shaped portable housing 44 housing these components. A rectangular opening is formed through a front face 45 of the housing 44, and X-rays are incident through this opening. An X-ray permeable plate 46 as a top panel is fitted in the opening.

The battery 42 supplies power to the components of the electronic cassette 15 via a power supply circuit (not shown). The battery 42 is unloadable from the housing 44 and rechargeable by a specific charger (not shown). The communicator section 43 is connected to the console 13 wirelessly or in a wired manner, to exchange various kinds of data with the console 13, including the image acquisition settings for X-ray imaging and X-ray images. The communicator section 43 also receives the selection signal from the console 13 when one electronic cassette 15 is selected to use for imaging.

The sensor panel 40 consists of a scintillator 47 and a photo detector circuit board 48. The scintillator 47 and the photo detector circuit board 48 are laminated in this order from the X-ray incident side. The scintillator 47 includes a phosphor, such as thallium-activated cesium iodide (CsI:T1) or terbium-activated gadolinium oxy sulfide ($Gd_2O_2S$:Tb), converts X-rays entering through the X-ray permeable plate 46 to visible rays and emits the visible rays to electric charges through the pixels 55. It may be possible to use another sensor panel in which a scintillator 47 is disposed on the opposite side of a photo detector circuit board 48 from the X-ray incident side. It may also be possible to use a sensor panel of a direct conversion type in which X-rays are directly converted to electric charges through a photoconductive layer, such as amorphous selenium.

The photo detector circuit board 48 detects the visible rays emitted from the scintillator 47 and converts the visible rays to an electric signal. The control circuit board 41 controls driving the photo detector circuit board 48 and produces an X-ray image on the basis of the electric signal output from the photo detector circuit board 48.

A power switch 49 is disposed on one side of the housing 44. The power switch 49 is operated by the user R when turning the power of the electronic cassette 15 on and off.

The wireless tag 50 is attached to one side of the housing 44. The wireless tag 50 stores information including the cassette ID. The wireless tag 50 is a passive tag that is activated upon receipt of the search signal from the wireless tag reader 21, and sends back a response signal that carries information including the cassette ID in response to the search signal. The search signal is periodically sent out. Thus, so long as one electronic cassette 15 stays in the service zone 20, the wireless tag 50 of the one electronic cassette 15 repeatedly receives the search signal and sends back the response signal. The wireless tag 50 may also be integrated in the housing 44.

Figure 5:
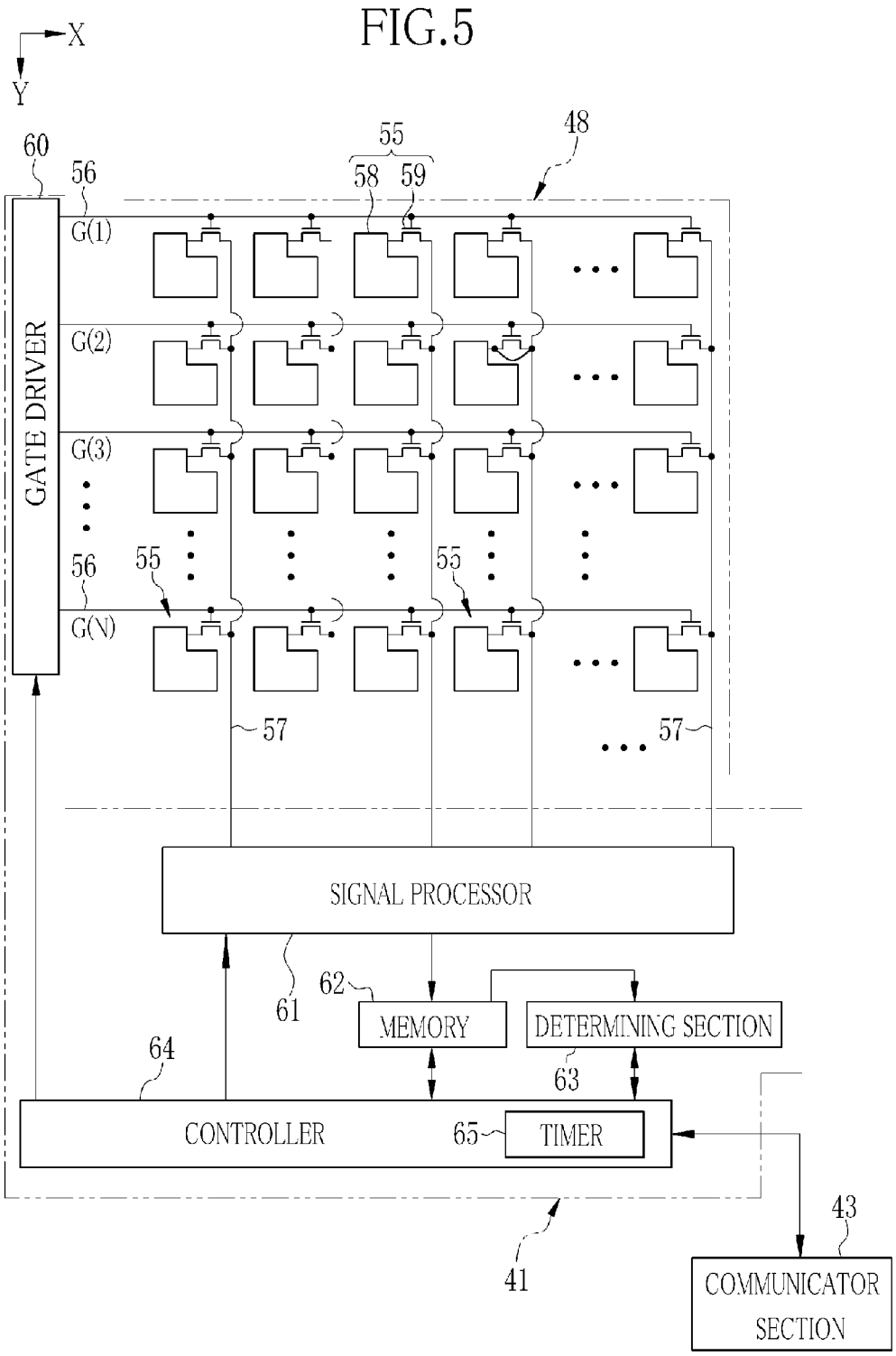
FIG. 5 is a block diagram illustrating an internal structure of the electronic cassette.

Referring to FIG. 5, the photo detector circuit board 48 is provided with pixels 55 arranged in a two-dimensional matrix of N lines and M columns on a glass substrate (not shown), N scanning lines 56 and M signal lines 57. "N" and "M" represent plural integers, e.g., M, N=around 2000. The scanning lines 56 extend in X-direction along the lines of the pixels 55 and are spaced at predetermined intervals from each other in Y-direction along the columns of the pixels 55. The signal lines 57 extend in the Y-direction and are spaced at predetermined intervals in the X-direction. The scanning lines 56 and the signal lines 57 orthogonally intersect with each other, and the pixels 55 are provided corresponding to the cross points between the scanning lines 56 and the signal lines 57. The arrangement of the pixels 55 is not limited to the square matrix array as shown in the illustrated example, but may be a honeycomb array.

The pixels 55 each have a photoelectric converter section 58 and a thin film transistor (TFT) 59 as a switching element, as well known in the art. The photoelectric converter section 58 generates electric charges (pairs of electrons and positive holes) according to incident visible rays and accumulates the generated electric charges. The photoelectric converter section 58 is constituted of a semiconductor layer and upper- and lower electrodes disposed on the top and bottom of the semiconductor layer. For example, the semiconductor layer is of a PIN (p-intrinsic-n) type wherein an n-type layer is formed on the side of the upper electrode and a P-type layer is formed on the side of the upper electrode. The TFT 59 is connected at its gate electrode to the scanning line 56, at its source electrode to the signal line 57 and at its drain electrode to the lower electrode of the photoelectric converter section 58. Note that a CMOS (complementary metal oxide semiconductor) type sensor panel may also be used instead of an TFT type.

The upper electrodes of the photoelectric converter sections 58 are connected to bias lines (not shown). The bias lines are provided in same number as the number of lines of the pixels 55 (N lines). The bias lines are connected together to a bus line, which is connected to a bias power source. Through the bus line and the respective bias lines, a positive bias voltage is applied to the upper electrodes of the photoelectric converter sections 58. The applied positive bias voltage induces an electric field inside the semiconductor layer of each photoelectric converter section 58. The photoelectric converter section 58 is used under a reverse bias condition. Among the pairs of electrons and holes, which are generated through the photoelectric conversion in the semiconductor layer, the electrons move to the upper electrode and are absorbed in the bias line, whereas the holes move to the lower electrode and are collected as signal charges.

The control circuit board 41 is provided with a gate driver 60, a signal processor 61, a memory 62, a determining section 63 and a controller 64 for controlling these components. The gate driver 60 is connected to one terminals of the respective scanning lines 56 and outputs gate pulses G(K) (K=1 to N) for driving the TFTs 59. The controller 64 drives the TFTs 59 through the gate driver 60, to thereby cause the sensor panel 40 to perform a pre-irradiation reading operation for reading out signal charges from the pixels 55 before the start of an X-ray irradiation, an accumulating operation for accumulating signal charges in each pixel 55 according to the amount of X-rays incident on the pixel 55, and an image reading operation for reading out the accumulated signal charges from the pixels 55 after the end of the X-ray irradiation.

In the accumulating operation, the gate driver 60 does not give the gate pulses G(K) to any of the scanning lines 56. Thus, the TFTs 59 are off during the accumulating operation. While the TFT 59 is off, signal charges are accumulated in the pixel 55 according to the incident amount of X-rays. In the pre-irradiation reading operation and the image reading operation, the gate driver 60 sequentially outputs the gate pulses G(K) one to one scanning line 56 at regular intervals from the first to the last of the N scanning lines 56, thereby turning on those TFTs 59 connected to the same scanning line 56 at a time and thus turn on the TFTs 59 line-sequentially.

The signal processor 61 is connected to one terminals of the respective signal lines 57. The signal processor 61 coverts the signal charges read out from the pixels 55 in the pre-irradiation reading operation or the image reading operation to digital voltage values (signal voltages), and outputs these values to the memory 62. The memory 62 stores the digital signal voltages output from the signal processor 61. Hereinafter, the digital signal voltages stored in the memory 62 as a result of the pre-irradiation reading operation will be referred to as a dose signal (refer to FIG. 6) and the digital signal voltages stored in the memory 62 as a result of the image reading operation will be referred to as an image signal (refer to FIG. 6).

The determining section 63 is driven under the control of the controller 64. The determining section 63 determines whether the X-ray source 10 starts an X-ray irradiation or not on the basis of the dose signal. When the determining section 63 determines that an X-ray irradiation has started, the determining section 63 outputs an irradiation start determination signal to the controller 64 (refer to FIG. 6).

The controller 64 has an integrated timer 65. The timer 65 is set up with the irradiation time that is contained in the image acquisition settings determined on the console 13. The timer 65 starts counting upon receipt of the irradiation start determination signal from the determining section 63. The controller 64 determines that the X-ray irradiation stops when the time counted by the timer 65 reaches the irradiation time set in the timer 65.

Figure 6:
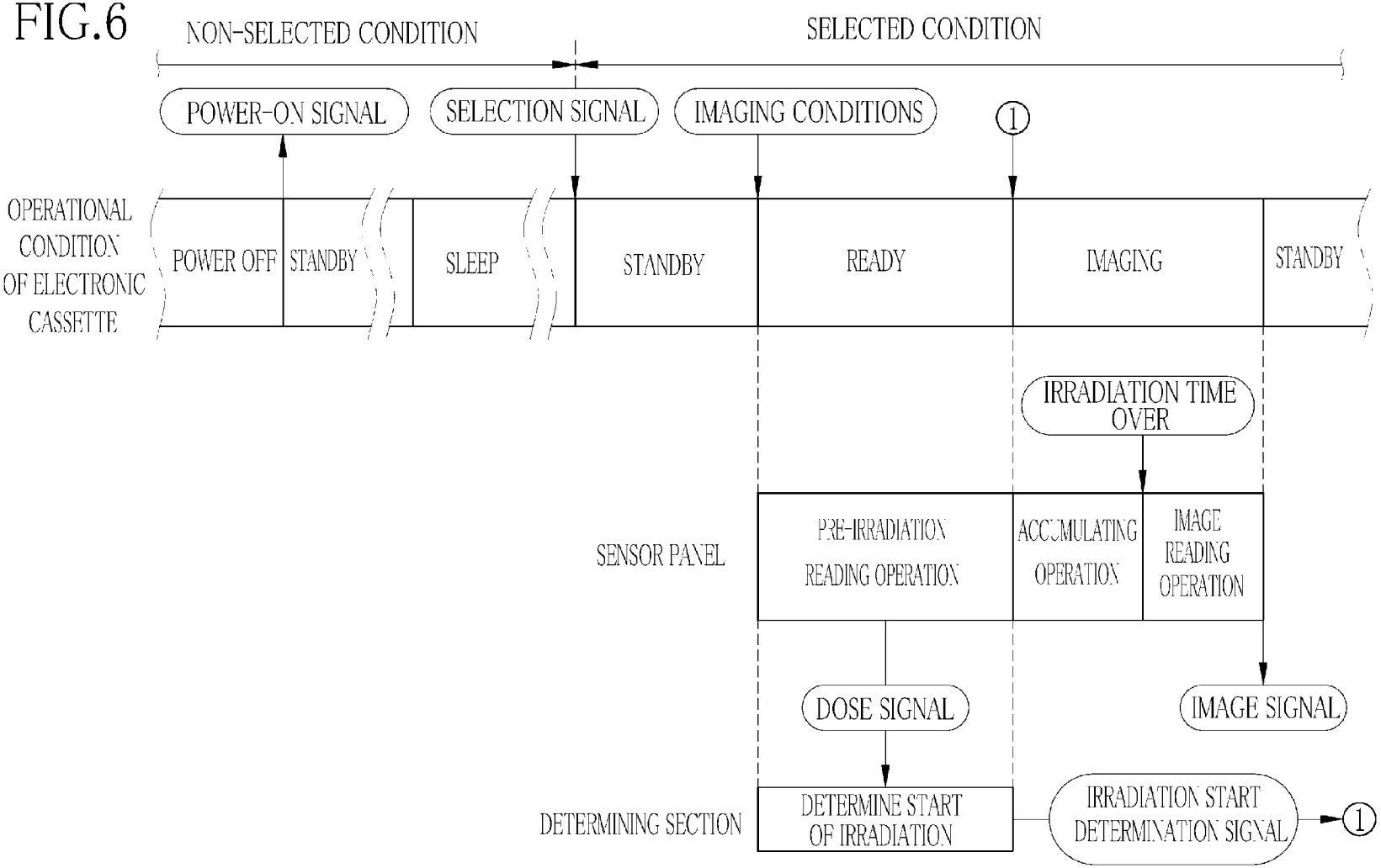
FIG. 6 is an explanatory diagram illustrating the operation sequences of the electronic cassette, a sensor panel and a determining section.

In FIG. 6, the electronic cassette 15 has five operation modes: power-off mode, standby mode, sleep mode, ready mode and image acquisition mode.

Upon the power switch 49 being turned on, the electronic cassette 15 transmits a power-on signal to the console 13 via the communicator section 43, indicating that the power source is turned on, and the electronic cassette 15 gets in the standby mode. If no operation is applied to the electronic cassette 15 for a certain time in the standby mode, the electronic cassette 15 moves to the sleep mode. When the electronic cassette 15 in the sleep mode receives the selection signal from the console 13, indicating that the electronic cassette 15 is selected to use for X-ray imaging, the electronic cassette 15 moves back to the standby mode. When the electronic cassette 15 in the standby mode receives data of image acquisition settings from the console 13, the electronic cassette 15 moves to the ready mode. When the determining section 63 determines the start of an X-ray irradiation and outputs the irradiation start determination signal to the controller 64 in the ready mode, the electronic cassette 15 moves to the image acquisition mode.

In the standby mode and the sleep mode, the controller 64 stops supplying power to the gate driver 60 and the signal processor 61, and drives the communicator section 43 only. Accordingly, the sensor panel 40 does not work in the standby mode and the sleep mode. In the ready mode, the controller 64 controls the sensor panel 40 to execute the pre-irradiation reading operation and output the dose signal to the memory 62. In the image acquisition mode, the controller 64 controls the sensor panel 40 to execute the accumulating operation. When the controller 64 receives the irradiation start determination signal from the determining section 63, the controller 64 immediately stops the pre-irradiation reading operation and starts the accumulating operation even while the pre-irradiation reading operation is being conducted on an intermediate line of the pixels 55. Thus, the starting time of the accumulating operation is synchronized with the starting time of the X-ray irradiation.

When the time counted by the timer 65 reaches the irradiation time, which is set as one image acquisition setting, the controller 64 determines that the X-ray radiation is terminated. Then the controller 64 controls the sensor panel 40 to execute the image reading operation to output the image signal to the memory 62. The image signal output to the memory 62 is transmitted as an X-ray image to the console 13 via the communicator section 43.

Figure 27:
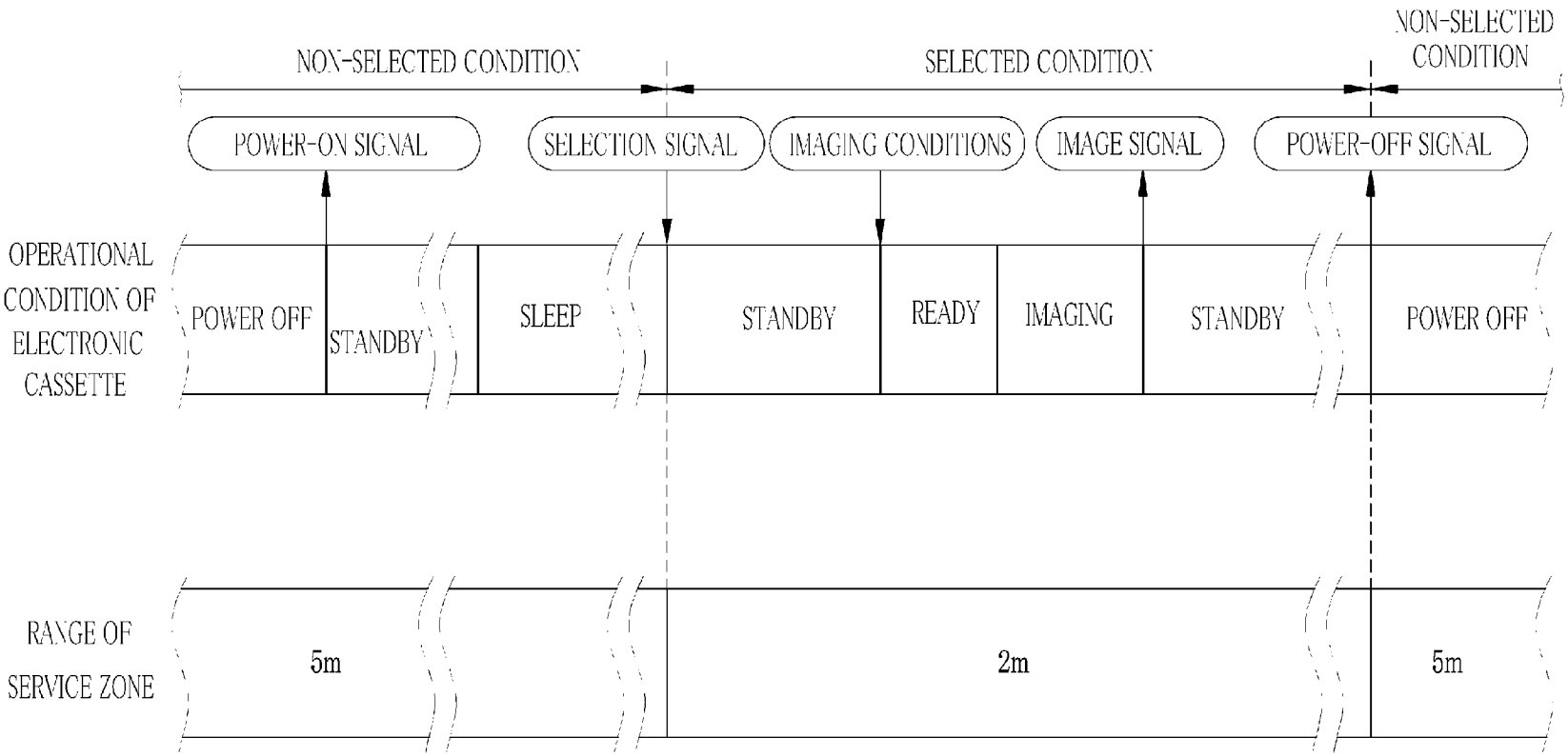
FIG. 27 is an explanatory diagram illustrating the variations in the range of the service zone depending on the operational conditions of the electronic cassette.

At the end of the image reading operation, the electronic cassette 15 returns to the standby mode. When the power switch 49 is turned off, the electronic cassette 15 transmits a power-off signal (refer to FIG. 27) to the console 13 via the communicator section 43, indicating that the electronic cassette 15 gets in the power-off mode.

The power-off mode, the standby mode from the power-on to the receipt of the selection signal and the sleep mode are comprehended in a non-selected condition of the electronic cassette 15, wherein the electronic cassette 15 is not selected to use for imaging. The standby mode after the receipt of the selection signal, the ready mode and the image acquisition mode are comprehended in a selected condition of the electronic cassette 15, wherein the electronic cassette 15 is selected to use for imaging. The standby mode after the image acquisition mode is comprehended in the selected condition of the electronic cassette 15 until another electronic cassette 15 is selected on the cassette selection window 31 or the electronic cassette 15 moves to the sleep mode.

At each output of the dose signal concerning one line of the pixels 55 to the memory 62, the determining section 63 compares a representative value of the dose signal concerning one line with a predetermined threshold value. The greatest value among the dose signal values for one line is preferable as the representative value to be compared with the threshold value, but may also be the mean value or the sum of the dose signal values for one line. The dose signal begins to increase with the start of X-ray irradiation, and the representative value of the dose signal will reach a level above the threshold value in a certain time. At the time when the representative value of the dose signal exceeds the threshold value, the determining section 63 determines that the X-ray irradiation has started.

Figure 7:
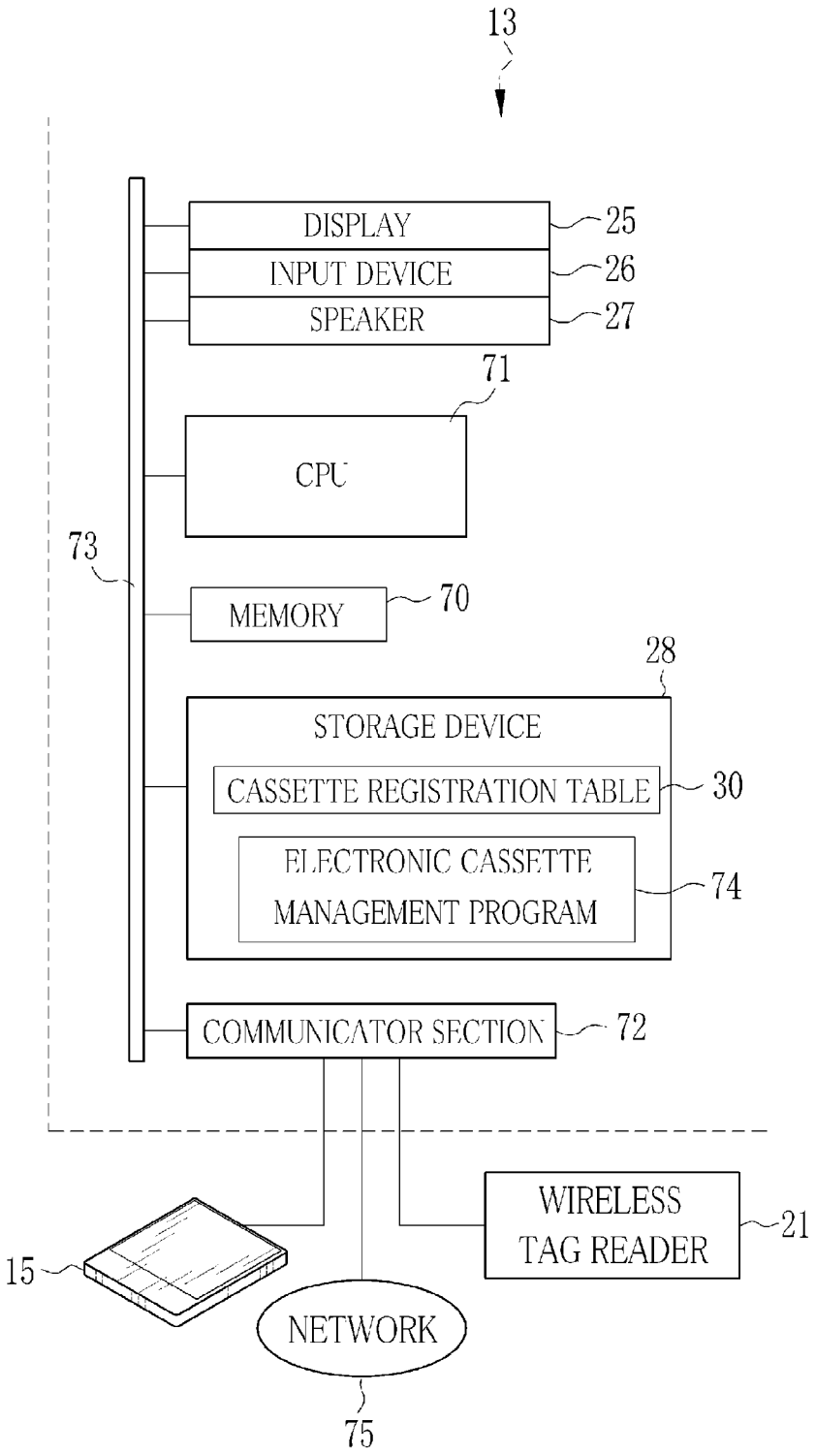
FIG. 7 is a block diagram illustrating a computer constituting a console.

In FIG. 7, the console 13 is constituted of a computer which is equipped with the display device 25, the input device 26, the speaker 27 and the storage device 28, as described above, and also with a memory 70, a CPU (central processing unit) 71 and a communicator section 72. These components are interconnected through a data bus 73.

The storage device 28 stores control programs, such as operating systems, and a variety of application programs, including an electronic cassette management program 74, in addition to the cassette registration table 30. The electronic cassette management program is for making the computer that constitutes the console 13 function as the electronic cassette surveillance apparatus in cooperation with the wireless tag reader 21.

The memory 70 is a work memory for the CPU 71 to execute processing. The CPU 71 loads the programs from the storage device 28 onto the memory 70 and executes processing according to the loaded programs, thereby overall controlling the components of the computer.

The communicator section 72 is connected to the communicator section 43 of each electronic cassette 15 wirelessly or in a wired manner. Furthermore, within each service zone 20, the communicator section 72 is connected to the wireless tag reader 21, so that the communicator section 72 receives the detection results from the wireless tag reader 21 on the come and go of the respective electronic cassettes 15 into and out of the service zone 20. Moreover, the communicator section 72 functions as a network interface for transmission of various kinds of information between the consoles 13 and other external devices over a network 75 such as a LAN (local area network) laid in the medical facility. The communicator section 72 receives the power-on signal, the power-off signal and X-ray images from the electronic cassette 15, and sends the selection signal and the image acquisition settings to any one of the electronic cassettes 15. The communicator section 72 also receives the detection results, which have been obtained by the wireless tag reader 21 for another service zone 20, from the console 13 of another radiography room 2, and sends the detection results obtained by the wireless tag reader 21, which is connected to the communicator section 72, to the console 13 of another radiography room 2.

Figure 8:
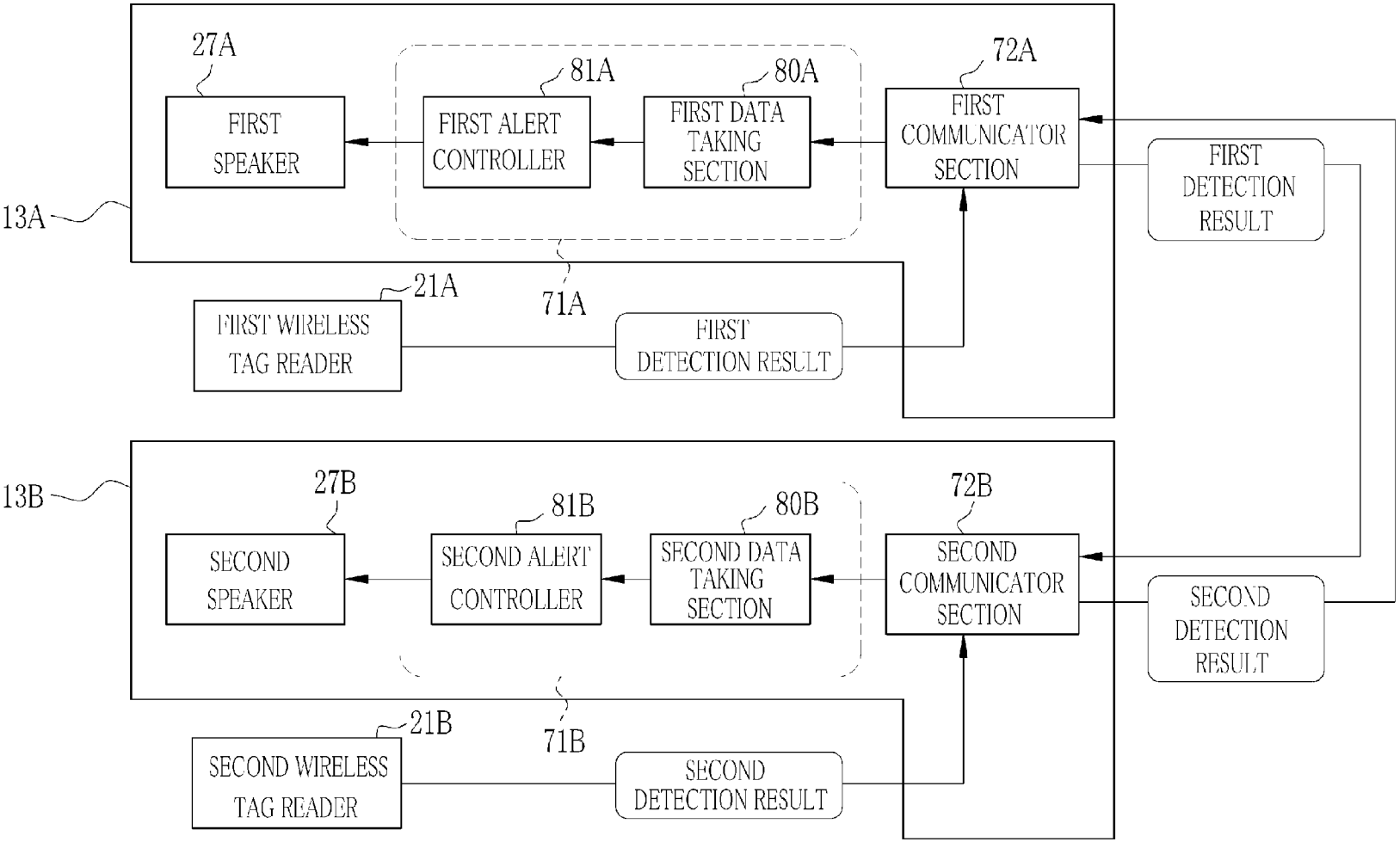
FIG. 8 is a block diagram illustrating functions of a CPU of the console.

Referring to FIG. 8, when the electronic cassette management program is activated, the CPU 71 serves as a data taking section 80 and an alert controller 81 in cooperation with the memory 70.

A first data taking section 80A of the first console 13A takes the detection results on the come and go of the electronic cassettes 15 into or out of the first service zone 20A (the first detection results), which are obtained by the first wireless tag reader 21A. The first data taking section 80A also takes the detection results on the come and go of the electronic cassettes 15 into or out of the second service zone 20B (the second detection results), which are obtained by the second wireless tag reader 21B and sent from the second console 13B via the network 75 and received on the first communicator section 72A. The first data taking section 80A transfers the first and second detection results to the first alert controller 81A.

Figure 9:
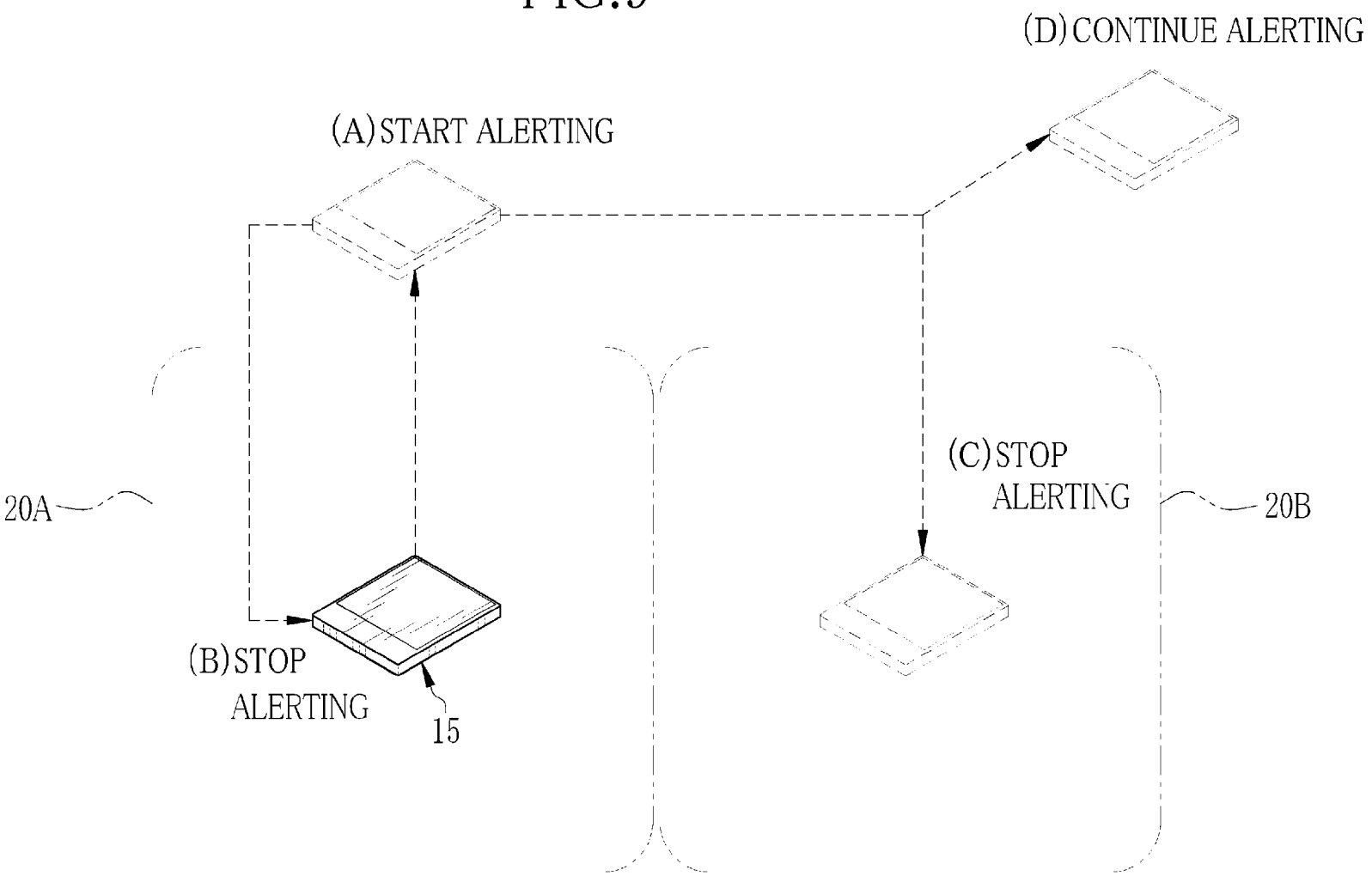
FIG. 9 is an explanatory diagram illustrating the timing of starting and stopping the alert by an alert controller.

The first alert controller 81A controls driving the first speaker 27A on the basis of the first and second detection results from the first data taking section 80A. More specifically, when the first alert controller 81A determines on the basis of one first detection result that one of the electronic cassettes 15 is brought out of the first service zone 20A, the first alert controller 81A drives the first speaker 27A to start warning, as shown in FIG. 9A. After the first speaker 27A starts alerting, when the first alert controller 81A determines on the basis of another first detection result that the one electronic cassette 15 is brought back into the first service zone 20A, the first alert controller 81A stops driving the first speaker 27A to stop the alert, as shown in FIG. 9B. Furthermore, when the first alert controller 81A determines on the basis of one second detection result that the one electronic cassette 15 is brought into the second service zone 20B, the first alert controller 81A stops driving the first speaker 27A to stop the alert, as shown in FIG. 9C. After the first alert controller 81A determines that one electronic cassette 15 is brought out of the first service zone 20A, the first alert controller 81A drives the first speaker 27A to keep the alert so long as the first alert controller 81A determines on the basis of the following first and second detection results that the one electronic cassette 15 does not exist either in the first service zone 20A or in the second service zone 20B. The above description referring to FIGS. 8 and 9 mainly relates to the first console 13A, but the same applies to the second console 13B. For example, a second 81B of the second console 13B drives the second speaker 27B to start warning when the second alert controller 81B determines on the basis of one second detection result that one of the electronic cassettes 15 is brought out of the second service zone 20B.

Figure 10:
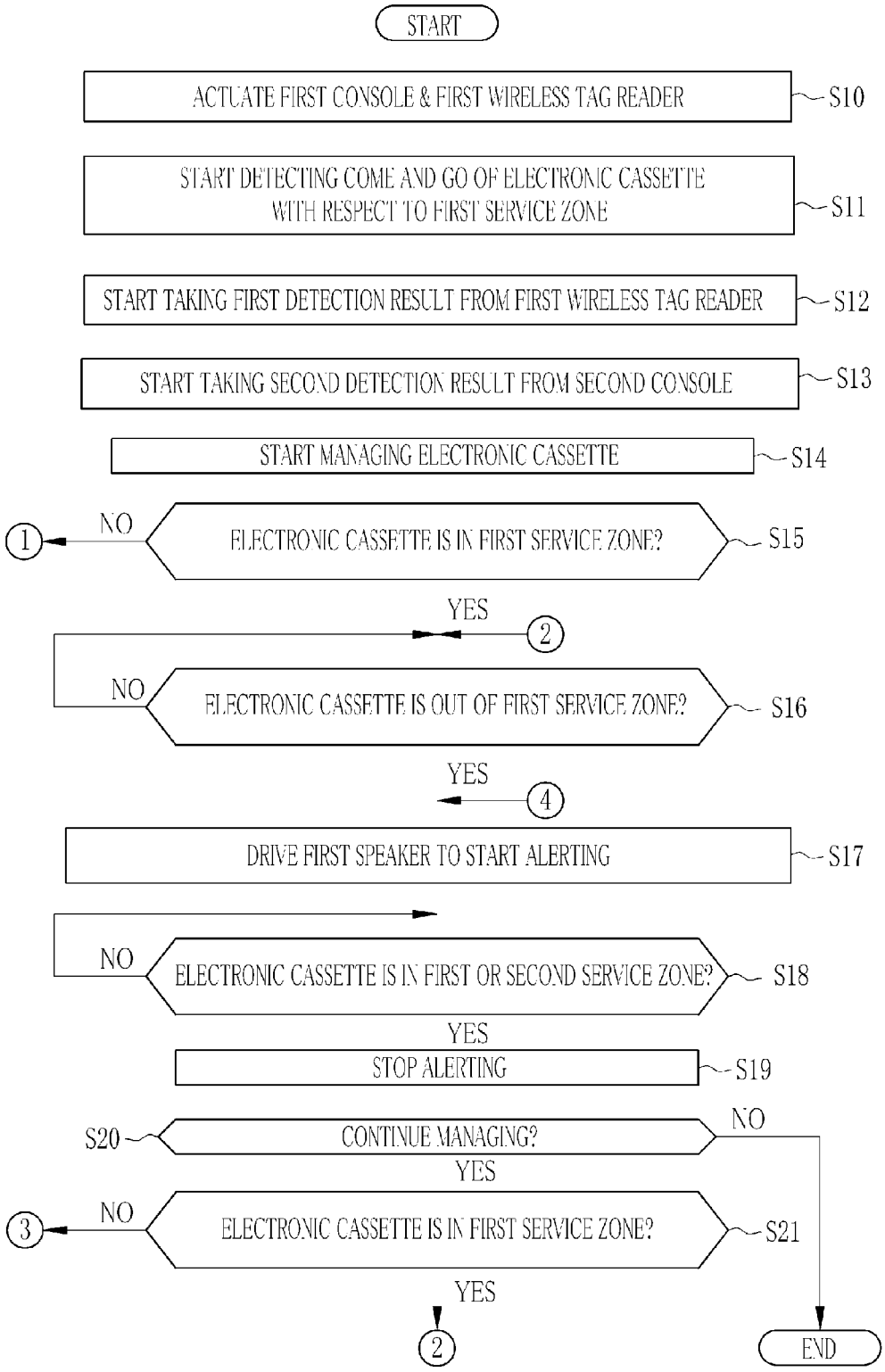
FIGS. 10 and 11 show a flowchart illustrating the operation sequence of the console and a wireless tag reader.
Figure 11:
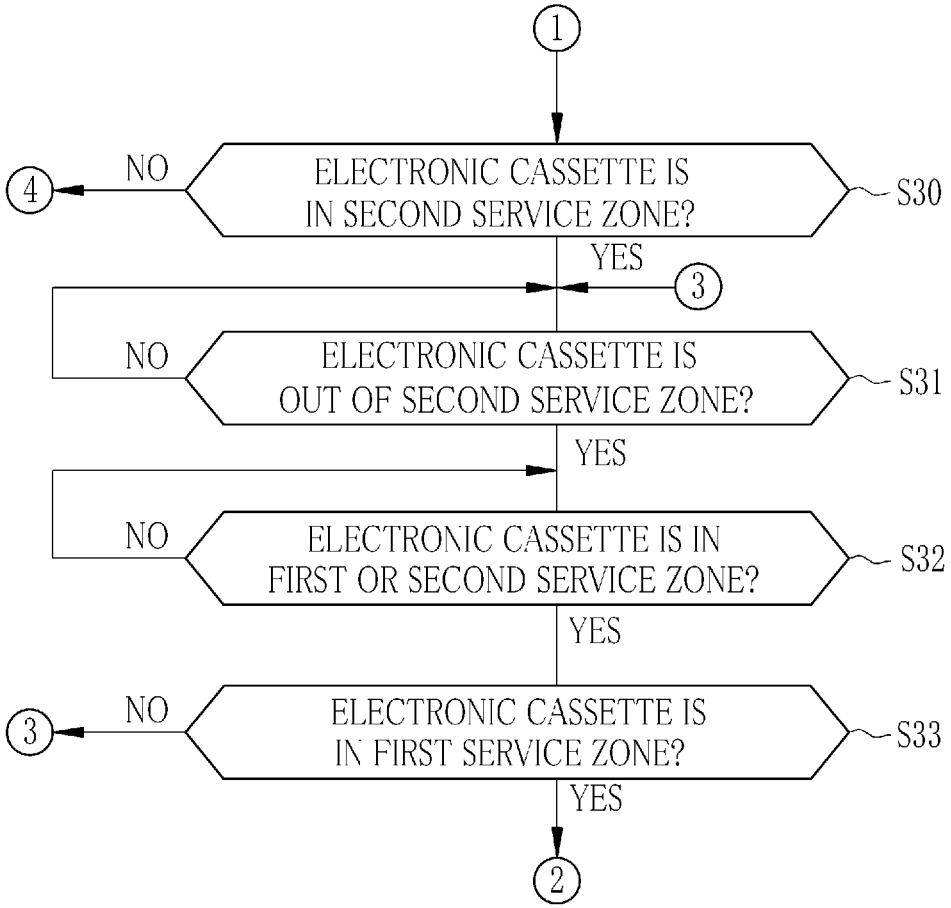

Now the operation of the above-described configuration will be described with reference to FIG. 9 and the flow chart in FIGS. 10 and 11, showing an operation sequence for the first console 13A and the first wireless tag reader 21A while the electronic cassette management program is being executed. First, as shown in step S10, the first console 13A and the first wireless tag reader 21A are actuated. As shown in step S11, the first wireless tag reader 21A starts detecting passage of the electronic cassettes 15 into and out of the first service zone 20A by periodically sending out the search signals and receiving the response signals from the wireless tags 50 of the electronic cassettes 15. The first data taking section 80A starts taking the first detection result, which the first wireless tag reader 21A obtains on the basis of the response signal received thereon, through the first communicator section 72A (step S12).

In the same way as the second wireless tag reader 21B, the second wireless tag reader 2B also starts detecting passage of the electronic cassettes 15 into and out of the second service zone 20B. The second detection result obtained by the second wireless tag reader 21B is transferred from the second communicator section 72B of the second console 13B through the network 75 and the first communicator section 72A to the first data taking section 80A. Thus the first data taking section 80A starts taking the second detection result (step S13). In the manner as above, the first console 13A and the first wireless tag reader 21A start monitoring passage of the electronic cassettes 15 into and out of the first service zone 20A (step S14).

After the monitoring starts in step S14, when the first alert controller 81A determines that one of the electronic cassettes 15 is present in the first service zone 20A ("Yes" in step S15), the program proceeds to step S16. If it is determined that one of the electronic cassettes 15 is not in the first service zone 20A ("No" in step S15), the program proceeds to step S30, as shown in FIG. 11. Note that the step S15 and the following steps are executed with respect to each of the registered electronic cassettes 15.

In step S16, when the first alert controller 81A determines on the basis of the first detection result that one electronic cassette 15 is brought out of the first service zone 20A ("Yes" in step S16), the first alert controller 81A drives the first speaker 27A to start warning (step S17) (refer to FIG. 9A).

Accordingly, if, for example, the second user RB of the second radiography room 2B brings one of the electronic cassettes 15 out of the first radiography room 2A through the first staff entrance 8A to the passageway 7 with intent to use the one electronic cassette 15 in the second radiography room 2B, or if an unauthorized person fraudulently takes any of the electronic cassettes 15 out of the first radiography room 2A, the first speaker 27A starts sounding an alert. Thus, if any of the electronic cassettes 15 is taken out of the first radiography room 2A without being noticed by the first user RA in the first radiography room 2A, the first user RA is quickly warned of the fact that the electronic cassette 15 is taken out of the first service zone 20A.

After the start of an alert, the first speaker 27A keeps the alert so long as the first alert controller 81A does not determine that the one electronic cassette 15 enters the first service zone 20A or the second service zone 20B ("No" in step S18) (refer to FIG. 9D). Thus, in the case where someone other than the users R fraudulently takes the electronic cassette 15 out of the first radiography room 2A, e.g., with intent to steal, the alert continues. Thereby, the first user RA can notice the smuggle of the electronic cassette 15 and take measures against it, e.g., alerting it to security personnel of the medical facility.

When the electronic cassette 15 is returned to the first service zone 20A, as shown in FIG. 9B, or is brought into the second service zone 20B, as shown in FIG. 9C, the first alert controller 81A determines on the basis of the first or the second detection result that the electronic cassette 15 enters the first service zone 20A or the second service zone 20B ("Yes" in the step S18), and stops driving the first speaker 27A to cease the alert (step S19). Thus, the alert will stop insofar as the electronic cassette 15 is within a proper operational range, including the transportation of the electronic cassette 15 between the radiography rooms 2A and 2B. Accordingly, the user R would not be bothered by the continuous alert within the proper operational range of the electronic cassette 15.

After the alert stops in step S19, the first console 13A and the first wireless tag reader 21A continues monitoring passage of the electronic cassettes 15 into and out of the first service zone 20A ("Yes" in step S20), and if the first alert controller 81A determines on the basis of the first detection result that the one electronic cassette 15 that has been taken out of the first service zone 20A is present in the first service zone 20A ("Yes" in step S21), the program returns to the step S16. If the first alert controller 81A determines on the basis of the second detection result that the electronic cassette 15 is in the second service zone 20B not in the first service zone 20A ("No" in the step S21), the program proceeds to step S31 (refer to FIG. 11).

As shown in FIG. 11, when the program proceeds from the step S15 to the step S30, the first alert controller 81A determines on the basis of the second detection results whether the one electronic cassette 15 is in the second service zone 20B or not. If it is determined that the one electronic cassette 15 is not in the second service zone 20B ("No" in the step S30), the program returns to the step S17 in FIG. 10 and the first speaker 27A is driven to start warning. If, on the contrary, the first alert controller 81A determines that the one electronic cassette 15 is in the second service zone 20B ("Yes" in the step S30) and thereafter determines on the basis of the second detection result that the one electronic cassette 15 is taken out of the second service zone 20B ("Yes" in the step S31), the first alert controller 81A does not drive the first speaker 27A to start warning. In this case, the second alert controller 81B drives the second speaker 27B to start warning from the second speaker 27B.

Thereafter when the first alert controller 81A determines on the basis of the first or the second detection result that the one electronic cassette 15 enters the first service zone 20A or the second service zone 20B ("Yes" in the step S32), the first alert controller 81A determines on the basis of the first detection result whether the one electronic cassette 15 is in the first service zone 20A or not (step S33). Simultaneously, the second alert controller 81B also determines that the one electronic cassette 15 enters the first service zone 20A or the second service zone 20B, in the same way as the first alert controller 81A, and the alert from the second speaker 27B is stopped.

If the first alert controller 81A determines on the basis of the first detection result that the one electronic cassette 15 is in the first service zone 20A ("Yes" in the step S33), the program returns to the step S16 in FIG. 10. If the first alert controller 81A determines on the basis of the second detection result that the one electronic cassette 15 is in the second service zone 20B not in the first service zone 20A ("No" in the step S33), the program returns to the step S31.

It is to be noted that, in addition to or in place of sounding an alert by the speaker 27, it may be possible to blink the display device 25 or light a warning lamp that is provided separately from the console 13. In the first embodiment, the first speaker 27A is driven to give an alert only when any of the electronic cassettes 15 is moved out of the first service zone 20A, but it may be possible to drive all speakers 27 to sound an alarm when any of the electronic cassettes 15 is moved out of any service zone 20, including the second service zone 20B. It may also be possible to provide the electronic cassette 15 with a speaker or an indicator to give an alert from the speaker or indicator of the electronic cassette 15.

The console 13 may not necessarily be located in the service zone 20. For example, in a case where the console 13 is installed in an operation room separately from the radiography room 2, the service zone 20 need not cover the operation room. The serves zones 20 may partly overlap, so far as each service zone 20 is supervised by at least one console 13.

In the case where the service zones 20 partly overlap, when one electronic cassette 15 enters an overlap area of two service zones 20, the second data taking sections 80 of the consoles 13 that supervise the two service zones 20 take detection results indicating that the one electronic cassette 15 is in the two service zones 20, so that the alert controllers 81 of these consoles 13 determine that the one electronic cassette 15 is in the two service zones 20. Thereafter when the one electronic cassette 15 is moved from the overlap area to one of the two service zones 20, the second data taking sections 80 once determine that the one electronic cassette 15 has gone out the other service zone 20 but immediately determine that the one electronic cassette 15 is moved in one service zone 20. Therefore, no alert is given in that case. If the electronic cassette 15 is moved from the overlap area out of these service zones 20, the speakers 27 of the consoles 13 that supervise the two service zones 20 are driven to start warning.

The consoles 13 illustrated in the above first embodiment are installed in the radiography rooms 2, but a console may be of a portable type that the user R can handle for the X-ray imaging while carrying about the same. Examples of portable consoles are mobile phones, smart phones, tablet terminals, PDA (personal digital assistant), laptop computers, etc. Unlike the installed console 13, the service zone 20 supervised by the portable console is not fixed but defined in a region where the portable console is moved in.

In the above first embodiment, two service zones 20A and 20B are defined in the medical facility, but this is for the sake of simplifying the explanation, and it may be possible to define more than two service zones.

Figure 12:
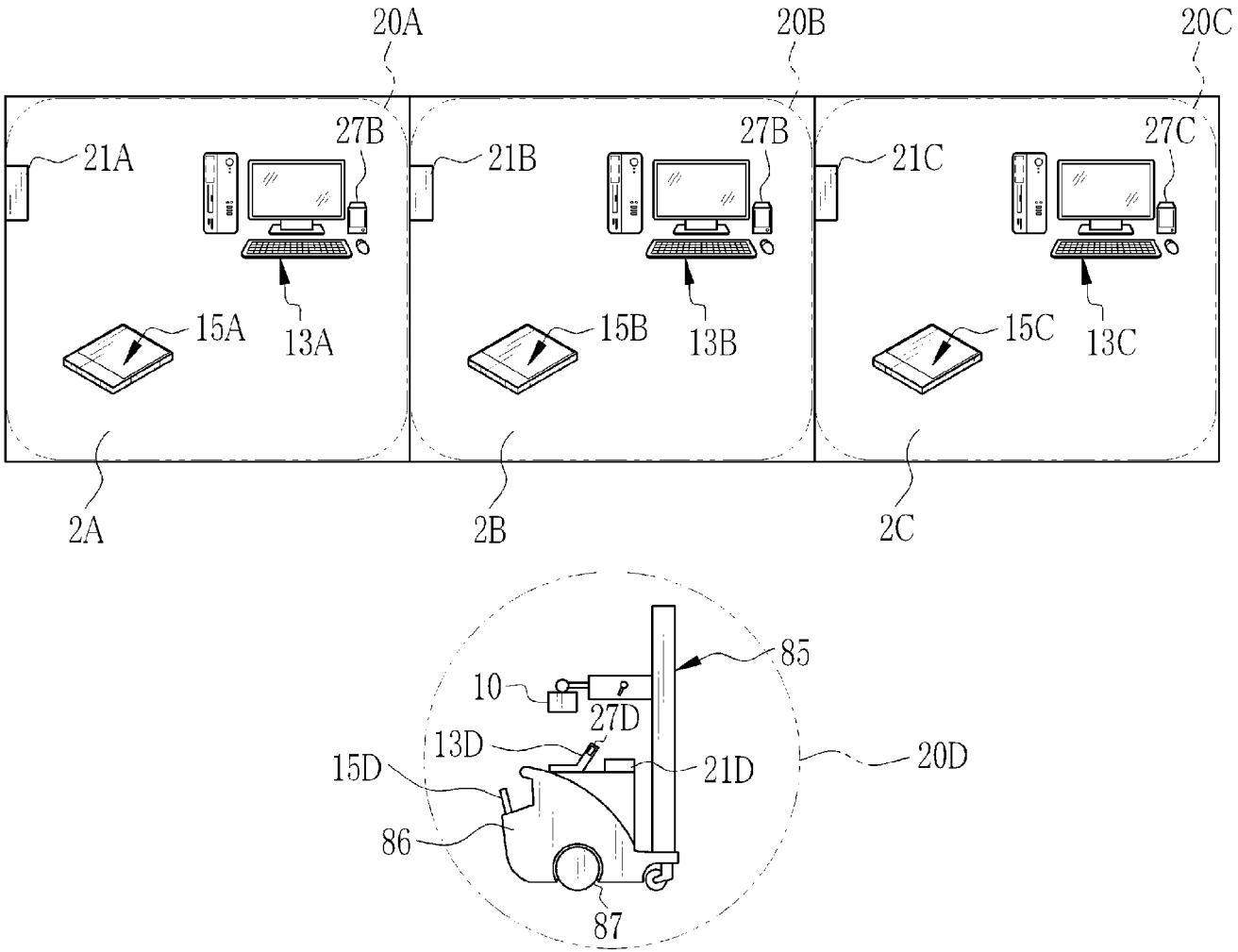
FIG. 12 is a diagram illustrating a situation wherein first to fourth service zones are allocated to first to third radiography rooms and a round-visit vehicle, respectively.

For example, as shown in FIG. 12, a first service zone 20A, a second service zone 20E, a third service zone 20C and a fourth service zone 20D may be defined with respect to a first radiography room 2A, a second radiography room 2B, a third radiography room 2C and a round-visit vehicle 85, respectively. In the first to third radiography rooms 2A to 2C, a first console 13A, a second console 13B and a third console 13C as well as first to third electronic cassettes 15A, 15B and 15C are disposed, respectively. The round-visit vehicle 85 has a structure wherein an X-ray source 10, a fourth console 13D and a container box 86 are integrally board on a mobile wagon 87. An electronic cassette 15D is contained in the container box 86.

The consoles 13A to 13D are interconnected through a network 75 (refer to FIG. 7). In addition, a first wireless tag reader 21A, a second wireless tag reader 21B, a third wireless tag reader 21C and a fourth wireless tag reader 21D are disposed in the radiography rooms 2A to 2C and the round-visit vehicle 85, respectively. Note that the doorways 6, the passageway 7, the X-ray sources 10 and the radiography stand or table 11 or 12 are omitted from the drawings in the following embodiments.

The fourth service zone 20D allocated to the round-visit vehicle 85, for example, has a range of approximately 2-5 m diameter around the round-visit vehicle 85, which is the transmission range of an UHF band signal. The electronic cassettes 15A to 15D may be equal to those of the first embodiment, wherein the electronic cassettes 15A and 15B are of the same type, whereas the electronic cassettes 15C and 15D are of a different type.

In the same as in the first embodiment, when it is determined that one of the electronic cassette 15 has gone out any of the service zones 20A to 20D, at least a speaker 27 raises an alert in the one service zone 20. Thereafter when it is determined that the one electronic cassette 15 is moved in any of the service zones 20A to 20D, the alert is interrupted.

By defining a service zone 20 with respect to a mobile subject such as the round-visit vehicle 85, the alert will be given not only when the electronic cassette 15 is taken out of the round-visit vehicle 85 but also when the round-visit vehicle 85 is moved away from a patient bedroom while leaving the electronic cassette 15 behind in the patient bedroom, thereby preventing the electronic cassette 15 from being left behind.

The following second to fifth embodiments will be described on the assumption that four electronic cassettes 15A to 15D are shared among and moved across the service zones 20A to 20D, as is shown in FIG. 12.

Second Embodiment

Since one wireless tag reader 21 is provided in each service zone, and each detection result includes an ID of the individual wireless tag reader 21 that outputs the detection result, the detection results not only indicate the come and go of the electronic cassettes 15 into and out the service zones 20, but also indicate respective service zones in which the electronic cassettes 15 currently exist, i.e., current positions of the electronic cassettes 15. For example, a detection result indicating that one electronic cassette 15 enters the fourth service zone 20D also indicates that the one electronic cassette 15 is in the fourth service zone 20D and hence the current position of the one electronic cassette 15 is on or around the round-visit vehicle 85. Accordingly, in the present embodiment shown in FIG. 13, a CPU 71 of each console 13 is also served to function as a recording controller 90 for recording current positions of the electronic cassettes 15 on a storage device 28 and as a display controller 91 for displaying the respective current positions on a display device 25.

In this case, a data taking section 80 transfers the detection result, which is obtained through a communicator section 72, to an alert controller 81 and the recording controller 90. Furthermore, as shown in FIG. 14, a cassette registration table 92 including an item on the current position in addition to items included in the cassette registration table 30 in FIG. 2 is stored in the storage device 28. The recording controller 90 records the current position of each electronic cassette 15, which is determined by the detection result from the data taking section 80, in the cassette registration table 92. The recording controller 90 revises the current position data in the cassette registration table 92 each time the current position changes. In the present example, the first radiography room 2A (the first service zone 20A), the second radiography room 2B (the second service zone 20B), the third radiography room 2C (the third service zone 20C) and the round-visit vehicle 85 (the fourth service zone 20D) are recorded as the current positions of the electronic cassettes 15A, 15B, 15C and 15D, respectively.

Figure 15:
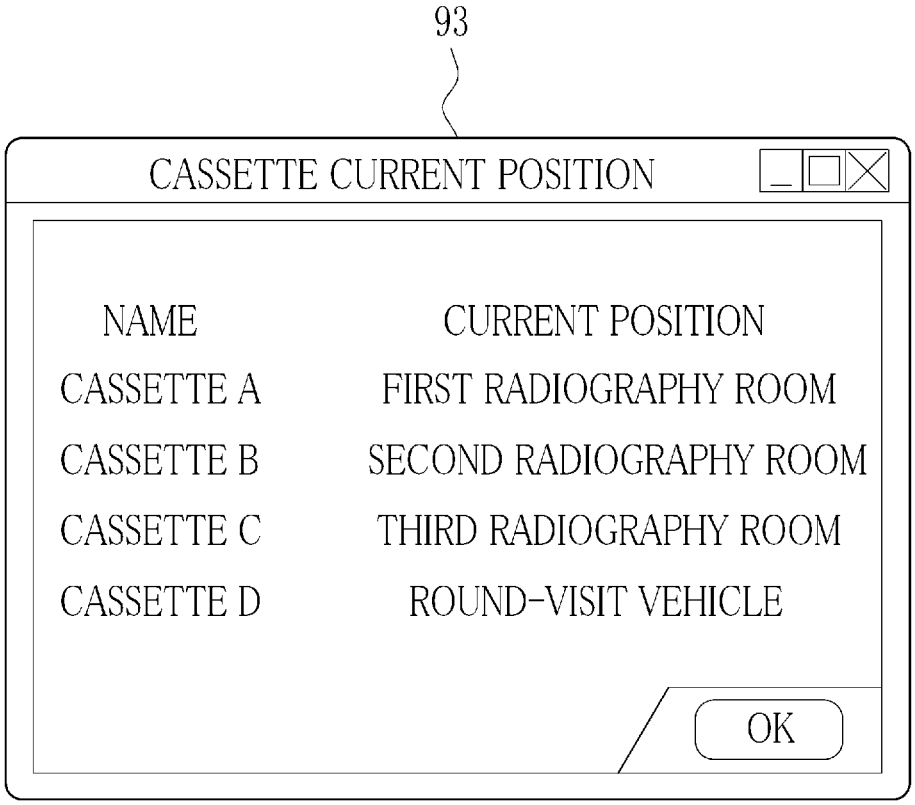
FIG. 15 is a diagram illustrating a window showing the current positions of the electronic cassettes.

The display controller 91 reads out the recorded current positions from the cassette registration table 92 in response to an operation command entered by the user R through an input device 26, and controls the display device 25 to display a current position window 93 shown in FIG. 15 on the basis of the read current positions. The current position and tracking record window 93 shows the names of the electronic cassettes 15A to 15D and the respective current positions. From the current position and tracking record window 93, the user R can confirm the current positions of the electronic cassettes 15.

Thus, enabling the user R to be informed of the current positions of the electronic cassettes 15 eliminates the labor of the user R to walk around the service zones in search of the electronic cassette 15 that the user R wants to use in the case where the electronic cassettes 15 are shared among and moved across a plurality of service zones. Since the users R can instantly see the current positions of the electronic cassettes 15, the users R may freely carry about the electronic cassette 15 without the need for permission or reporting thereafter. Accordingly, it becomes possible to make full use of the mobility of the electronic cassettes 15.

Figure 13:
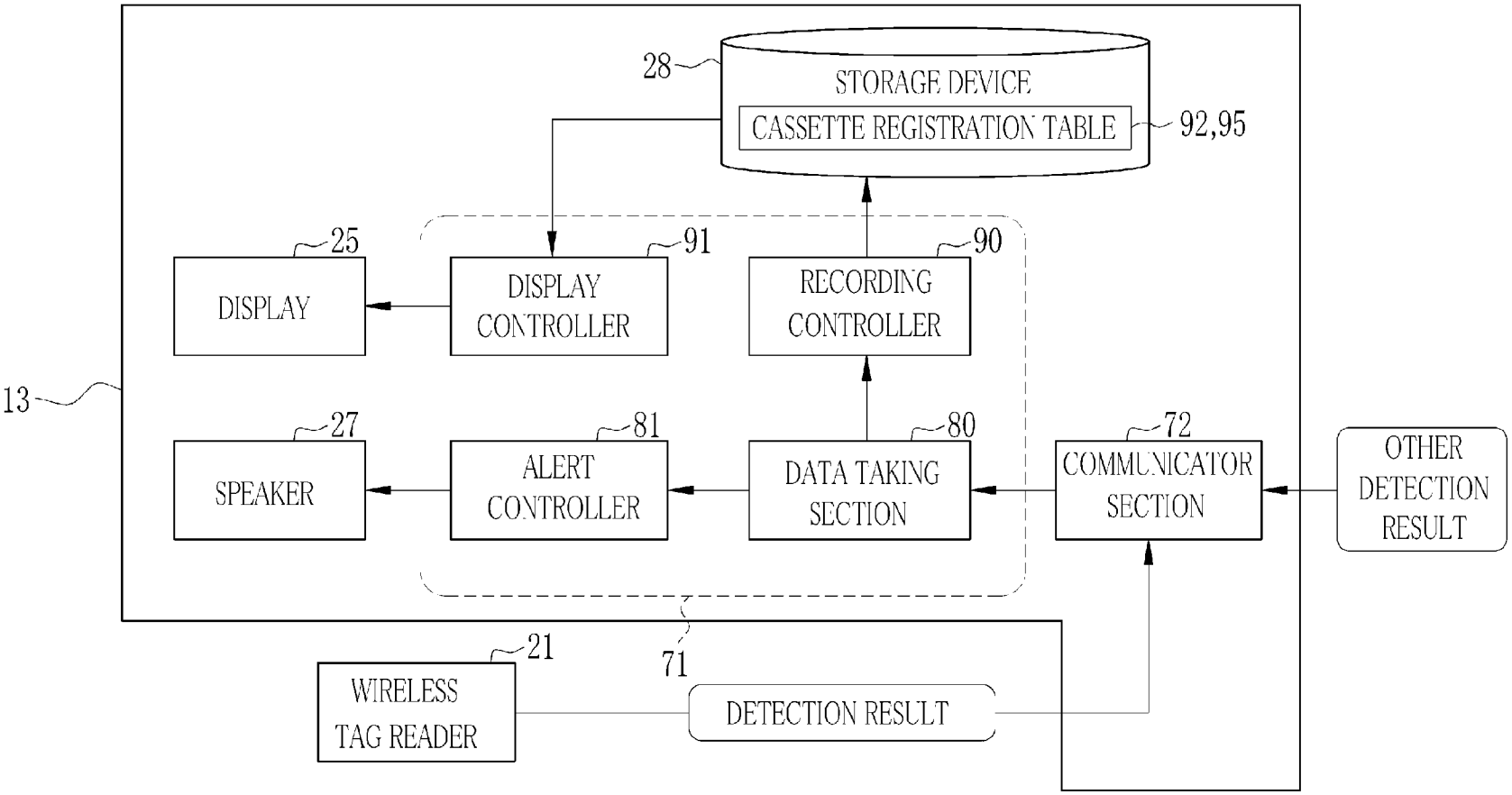
FIG. 13 is a block diagram illustrating functions of a CPU of a console, which is provided with a recording controller and a display controller in accordance with second and third embodiments.
Figure 19:
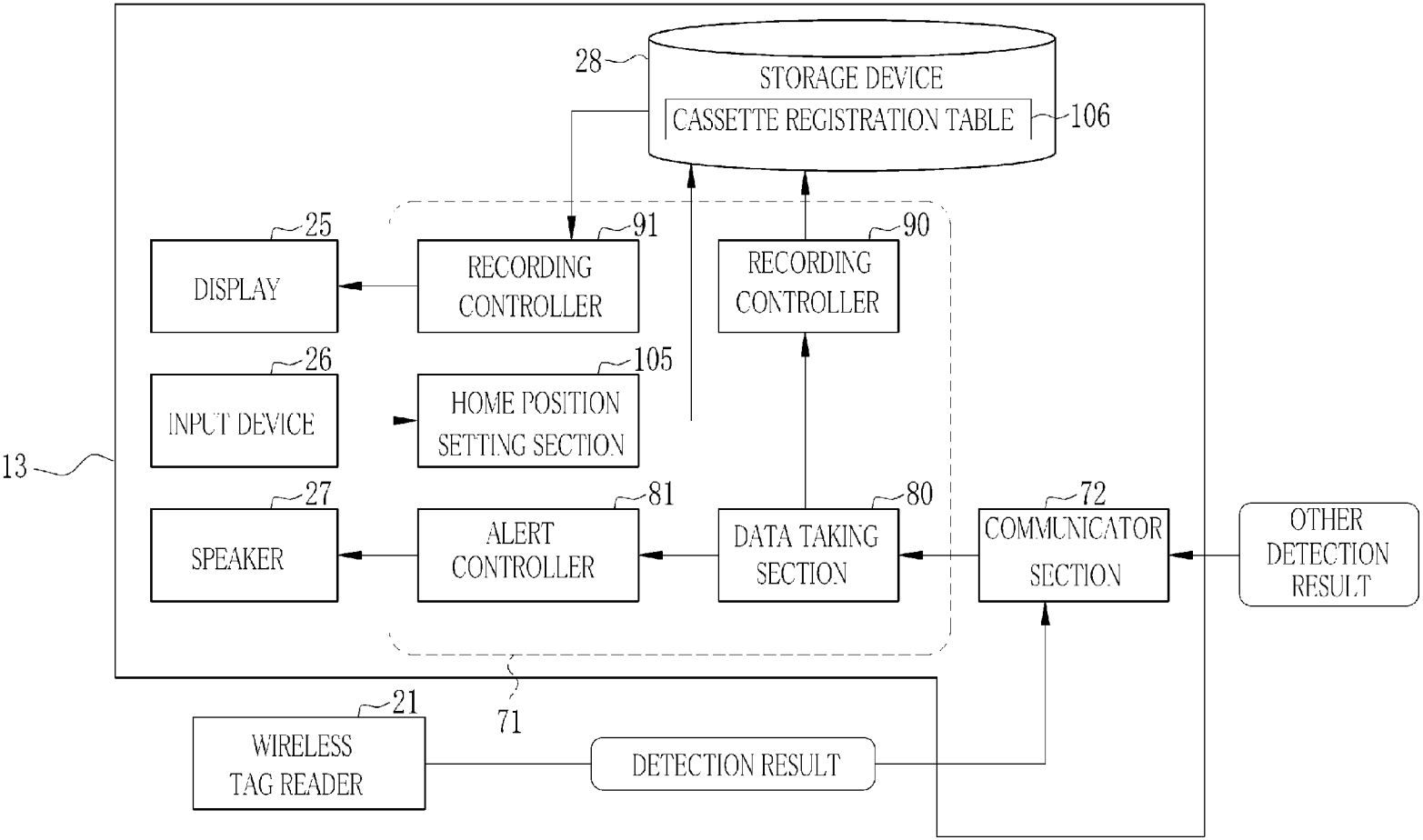
FIG. 19 is a block diagram illustrating functions of a CPU of a console, which is provided with a home position setting section in accordance with a fourth embodiment.
Figure 23:
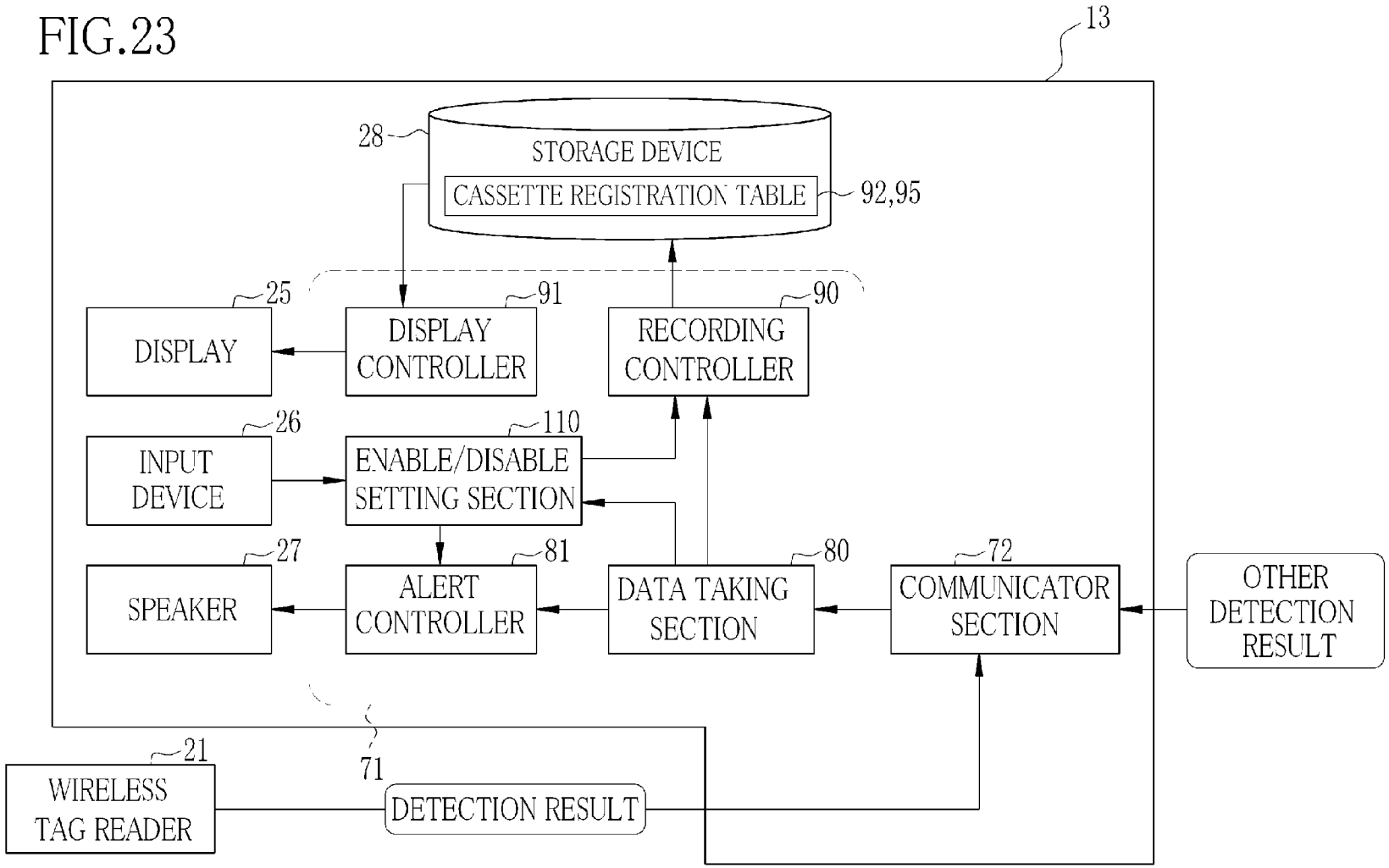
FIG. 23 is a block diagram illustrating functions of a CPU of a console, which is provided with an enable/disable setting section in accordance with a sixth embodiment.

In FIG. 13, "Detection Result" represents the detection results on the come and go of the electronic cassettes 15 into and out of one service zone 20 that is supervised by one console 13, whereas "Other Detection Result" represents those detection results on the come and go of the electronic cassettes 15 into and out of other service zones 20 supervised by other consoles 13, and those transmitted from other consoles 13 (the same applies to FIGS. 19 and 23). For example, provided that the one console 13 is the first console 13A, the "Detection Result" represents the first detection results from the first tag reader 21A, whereas the "Other Detection Result" represents the second to fourth detection results transmitted from the second to fourth consoles 13B to 13D. Provided that the one console 13 is the second console 13B, the "Detection Result" represents the second detection results from the second tag reader 21B, whereas the "Other Detection Result" represents the first, third and fourth detection results transmitted from the first, third and fourth consoles 13A, 13C and 13D.

Third Embodiment

The second embodiment is configured to record and display the current positions of the electronic cassettes 15. The third embodiment is configured to record and display not only the current positions but also former positions of the electronic cassettes 15 as tracking records. By successively recording the current position and former positions of each cassette, the tracking record will be acquired. For example, a detection result indicating that the first electronic cassette 15A is moved from the first service zone 20A to the service zone 20C indicates that the current position of the first electronic cassette 15 changes from the first service zone 20A to the service zone 20C. Note that other functional sections of a CPU 71 of each console 13 are equivalent to those shown in FIG. 13 with respect to the second embodiment, and thus the description of the functional sections will be omitted.

As shown in FIG. 16, according to the third embodiment, a storage device 28 stores a cassette registration table 95 that contains an item on tracking records of the electronic cassettes 15 (data relating to the electronic cassettes 15C and 15D is omitted in the drawing) in addition to the items of the cassette registration table 92 in FIG. 14. The item on tracking records of each electronic cassette 15 includes last four service zones, which have been recorded as the current positions, and the date and time of movement out of each of said service zones (the dates and times when the alert controller 81 determined that the electronic cassette 15 was moved out of these service zones). When a new current position of one electronic cassette 15 is determined by the detection results from the data taking section 80, the recording controller 90 rewrites the current position data of the cassette registration table 95 with the new current position, and revises the tracking records with the service zone that has been recorded as the current position and the date and time when it is determined that the one electronic cassette 15 was moved out of said service zone 20.

Taking the first electronic cassette 15 for example, if the current position thereof is in the first radiography room 2A, as shown in FIG. 16, and changes, for instance, to the round-visit vehicle 85, then the round-visit vehicle 85 is newly recorded as the current position of the first electronic cassette 15 in the cassette registration table 95. Furthermore, the tracking records are revised by deleting the oldest record, i.e. the round-visit vehicle and the move-out date and time therefrom (at 11:06 on Mar. 12, 2014) in this example, rewriting the second oldest record, i.e. the first radiography room and the move-out date and time therefrom (at 14:20 on Mar. 12, 2014), as the oldest record, and sequentially rewriting the following records of former positions and move-out dates and times in this way, and finally recording the first radiography room that has been recorded as the current position and the move-out date and time therefrom as the newest tracking record.

The display controller 91 reads out the current positions and the tracking records of the electronic cassettes 15 from the cassette registration table 95 in response to an operation command entered by the user R through an input device 26, and displays on the basis of the read current positions and the tracking records a current position and tracking record window 96 on a display device 25. As shown for example in FIG. 17, the current position and tracking record window 96 displays the cassette name (e.g., "Cassette A" corresponding to the first electronic cassette 15), the current position and the tracking records of each individual electronic cassette 15. Beside the current position are displayed the present date and time. As the tracking records, last four former positions of the electronic cassettes 15 and the respective move-out dates and times therefrom are displayed. On this current position and tracking record window 96, the user R can confirm the current position and the tracking records of each electronic cassette 15.

Thus, making it possible to inform the user R of the tracking records of each electronic cassette 15 in addition to the current position thereof enables the user R to see at one view the track of the electronic cassette 15 having been traveled around for operations. If it is necessary to switch over the operation modes of the electronic cassette 15 manually according to the applications, e.g. depending on whether the electronic cassette 15 is carried on the round-visit vehicle 85 or used in the radiography room 2, the tracking records help the user R instantly determine whether to switch over the operation modes or not, thereby smoothing the procedure of operation.

The number of former positions of each electronic cassette 15, which are to be recorded as the tracking records, is not limited to four. Furthermore, it may be possible to record the former positions of each electronic cassette 15 over a certain period, e.g. over the past month. By thus recording and storing a certain number of former positions, it becomes possible to know the trend of application of each electronic cassette 15, i.e., in which service zones and how long the electronic cassette 15 has been used. This can help planning the installation of the electronic cassette 15.

If it is unnecessary to switch over the operation modes of the electronic cassette 15 manually depending upon whether the electronic cassette 15 is used in the radiography room 2 or on the round-visit vehicle 85, the user R has to know only the current position of at least one electronic cassette 15 that the user R intends to use. Therefore, it is also possible to allow the user R to choose whether to display the current position only, like in the current position and tracking record window 93, or to display the tracking records in addition to the current position, like in the current position and tracking record window 96.

In a modification, each console may display the tracking records discriminating between those indicating the move-out of the electronic cassette 15 from one of the service zones 20 which is supervised by said console 13 and those indicating the move-out from other service zones 20. Taking the first console 13A for example, as supervising the first service zone 20A, the first console 13A displays the tracking records indicating the move-out of the electronic cassette 15 from the first service zone 20A distinguishably from those indicating the move-out from the second to fourth service zones 20B to 20D. More specifically, a first display controller 91A built in a first CPU 71A of the first console 13A causes a first display device 25A to display a current position and tracking record window 100 in a manner as shown in FIG. 18.

Figure 18:
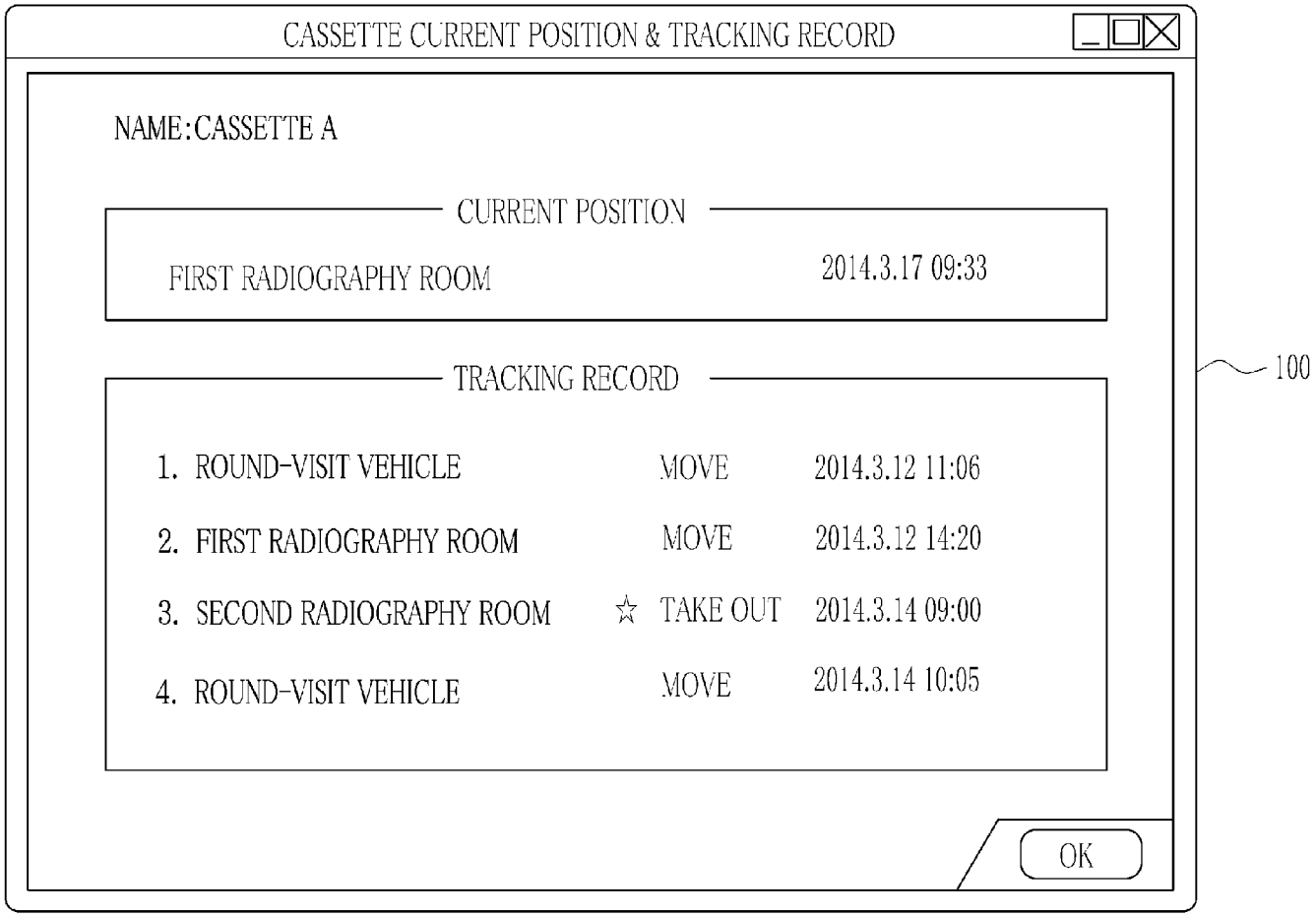
FIG. 18 is a diagram illustrating another example of a window showing the current positions and tracking records of the electronic cassettes.

Referring to FIG. 18, on the current position and tracking record window 100, the tracking records are discriminated between two kinds: "move" and "move-out", and the tracking record of "move-out" is asterisked. The tracking record of "move" indicates that the electronic cassette 15A (Cassette A) was moved from any of the second to fourth service zones 20B to 20D (the second and third radiography rooms 2B and 2C and the round-visit vehicle 85), whereas the tracking record of "move-out" indicates that the first electronic cassette 15 was moved out the first service zone 20A (the first radiography room 2A). In addition, the asterisk indicates that the first speaker 27A of the first console 13A gave an alert as the electronic cassette 15A was moved out of the first service zone 20A.

Thus, the console 13 can remarkably display those tracking records which indicate that the electronic cassette 15 was moved out of the service zone 20 that is supervised by said console 13. Any appropriate method for displaying the tracking records in a distinguishable manner is applicable to this embodiment, including differentiation by font color, font type, font style and blinking.

Figure 17:
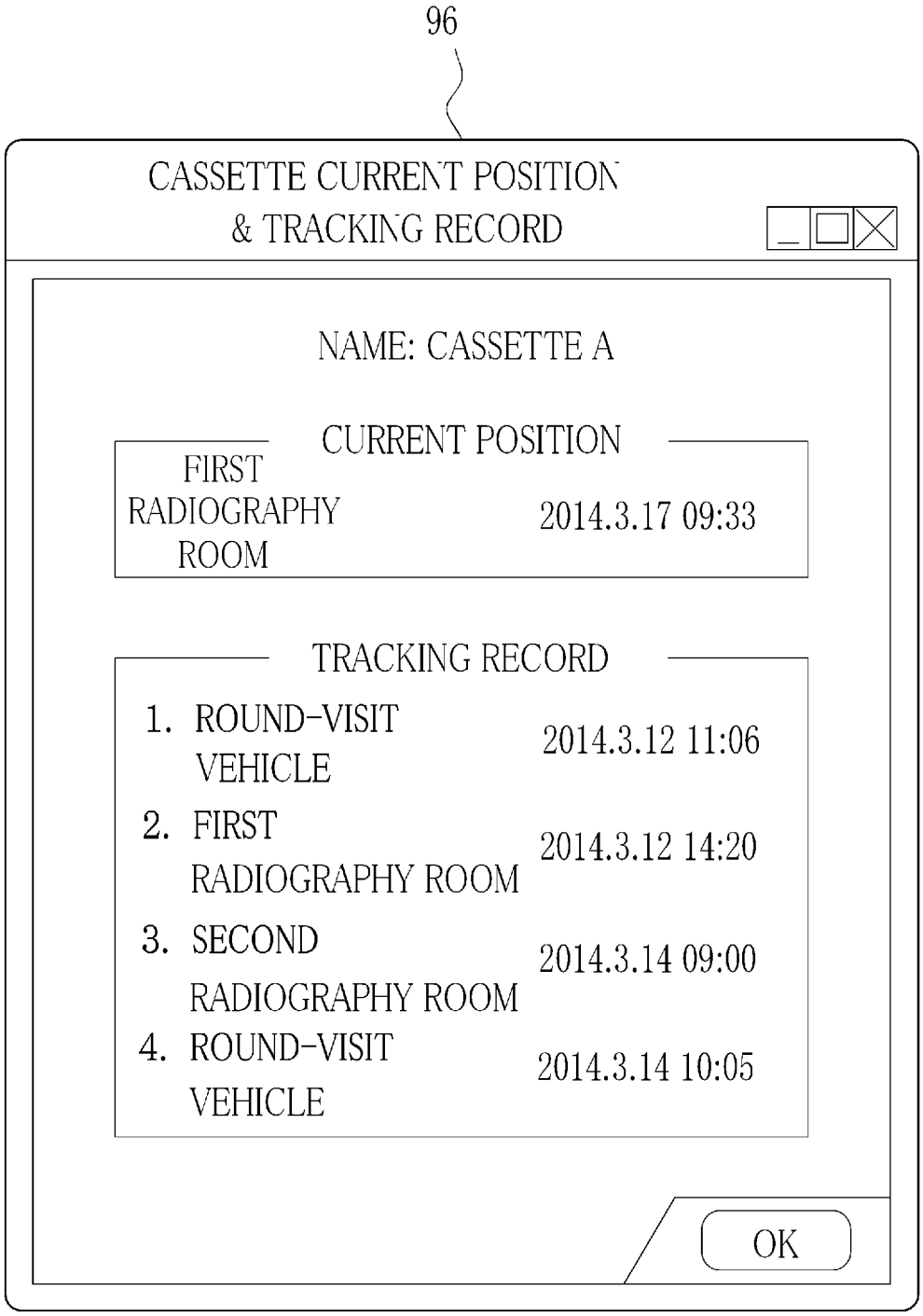
FIG. 17 is a diagram illustrating a window showing the current positions and tracking records of the electronic cassettes.

FIGS. 17 and 18 show examples displaying the current position and tracking records of the first electronic cassette 15 (Cassette A), but each console 13 can display the current position and tracking records of any of the electronic cassettes 15 which have been registered in the cassette registration table 95.

The way of displaying the current position or the tracking records is not limited to the current position and tracking record window 93 in FIG. 15 or the current position and tracking record window 96 or 100 in FIG. 17 or 18. For example, it is possible to display the current position and tracking records of a designated electronic cassette 15 by popping up a window when the name of the designated electronic cassette 15 is selected on the cassette selection window 31 shown in FIG. 3. This is preferable as the user R can see the current position and tracking records of each electronic cassette 15 concurrently when selecting any of the electronic cassettes 15 to use for radiography.

By applying a portable console to the above second or third embodiment, the user of the portable console can check the current position of any electronic cassette 15 or the tracking records thereof on the portable console without the need for accessing an installed console. Therefore, the user can move directly to the current position of a desired electronic cassette 15 to capture it, which facilitates the work procedure.

Fourth Embodiment

In some cases, as set forth above in the description of the electronic cassettes 15A and 15B, a main service zone of each individual electronic cassette 15, in which said electronic cassette is mainly used, may be determined within a medical facility. Therefore, according to the fourth embodiment, as shown in FIG. 19, a CPU 71 of a console 13 is provided with a home position designating section 105 for designating a home position to an electronic cassette 15, wherein the home position may be a service zone in an imaging room or around a round-visit vehicle, in which the electronic cassette 15 is determined to be mainly used. Also in the present embodiment, a recording controller 90 records the current position and tracking records of each electronic cassette in the same way as in the above third embodiment.

In this embodiment, as shown in FIG. 20, a storage device 28 stores a cassette registration table 106 containing an item on the home position in addition to the items of the cassette registration table 95 in FIG. 16. The designation of the home position may be done by the user R through an input device 26, for example, by selecting one of the first to third radiography rooms 2A to 2C or the round-visit vehicle 85 as the home position of one of electronic cassettes 15A to 15D registered in the cassette registration table 106. The home position setting section 105 records the designated home positions in the cassette registration table 106. In the illustrated example, the first to third radiography rooms 2A to 2C and the round-visit vehicle 85 are designated as the home positions of the electronic cassettes 15A to 15D, respectively.

The recording controller 90 deletes the tracking records of one electronic cassette 15 except the last former position thereof when the one electronic cassette 15 is moved back to the designated home position from another position. FIG. 20 shows an example in which the first electronic cassette 15A has moved back to the home position, the first radiography room 2A, and hence the recording controller 90 has deleted the tracking records of the first electronic cassette 15A except but the last former position (the round-visit vehicle 85). Since the second electronic cassette 15B is not moved back to the home position, the second radiography room 2B, the tracking records thereof remain undeleted.

If one electronic cassette 15 is in the home position thereof and the user R who intends to use the one electronic cassette 15 is also in that home position, the tracking records of the one electronic cassette 15 is not so important information for this user R. Accordingly, there is no problem in partly deleting the tracking records. Since some parts of the tracking records are automatically deleted, as being not so important for the user R, the capacity load on the storage device 28 is reduced. Furthermore, the deleted tracking records are not displayed on a current position and tracking record window 96 or 100 in this embodiment, thereby simplifying the display of tracking records and thus improving the visibility thereof.

Instead of deleting tracking records of one electronic cassette except the last former position when the current position of the one electronic cassette returns to the designated home position, it is possible to delete all the tracking records or delete the tracking records excluding the last two former positions. Alternatively, it may be possible for one console 13 to selectively delete a particular kind of tracking records, e.g. those tracking records indicating that the electronic cassette 15 was moved out other service zones 20 that are supervised by other consoles 13. Furthermore, it is possible to allocate multiple home positions to one electronic cassette. For example, as for such an electronic cassette that is evenly shared among all service zones, and no main service zone is assigned thereto, it is possible to designate all service zones as home positions.

Fifth Embodiment

In the above fourth embodiment, the home position is set up by the user R through the input device 26. In an alternative, such a location in which one electronic cassette 15 most frequently exists is determined with reference to tracking records of the one electronic cassette 15, to set up the location as the home position of said electronic cassette 15. Specifically, in the fifth embodiment, a home position designating section 105 analyzes tracking records written in a cassette registration table 106, and counts the respective numbers of times at which each of the electronic cassettes 15A to 15D has been located in the service zones 20A to 20D (the radiography rooms 2A to 2C and the round-visit vehicle 85), to create a tally table 107 shown in FIG. 21 (data being omitted with respect to the electronic cassettes 15C and 15D). Then, with reference to the tally table 107, the home position setting section 105 sets up one service zone where one electronic cassette has been most frequently located as the home position of the one electronic cassette.

In the illustrated example, the first electronic cassette 15 has been located most frequently on or around the round-visit vehicle 85, as indicated by hatching, and hence the home position setting section 105 sets up the round-visit vehicle 85 as the home position of the first electronic cassette 15. Since the second electronic cassette 15B has been located most frequently in the second radiography room 2B, the home position setting section 105 sets up the second radiography room 2B as the home position of the second electronic cassette 15B. As for other electronic cassettes, the respective home positions are set up in the same way. Thus, it is possible to determine the home positions of the electronic cassettes in accordance with the actual operational positions.

Like the above fourth embodiment, it is possible to allocate multiple home positions to one electronic cassette according to the present embodiment. For example, the home position may be two locations in which one electronic cassette has been located most and second most frequently. In the present embodiment, as the home position of each electronic cassette is determined on the basis of the frequency of presences of said electronic cassette in each service zone, it is preferable to store the tracking records over a relatively long period, without deleting the records even when the electronic cassette 15 is returned to the home position, in order to secure the adequacy or validity of the determined home position. To avoid frequent changes of the home positions, it is preferable to configure the home position setting section 105 to update the home positions periodically at regular intervals, e.g. every month.

It is also possible to combine the above fourth embodiment and the present embodiment such that the home position is determined by the user R and on the basis of the frequency of presences of each electronic cassette in each location in a combined manner. In this case, the home positions are initially determined by the user R and, after a certain number of tracking records are acquired, the determination of the home positions are switched to be based on the frequency.

Figure 22:
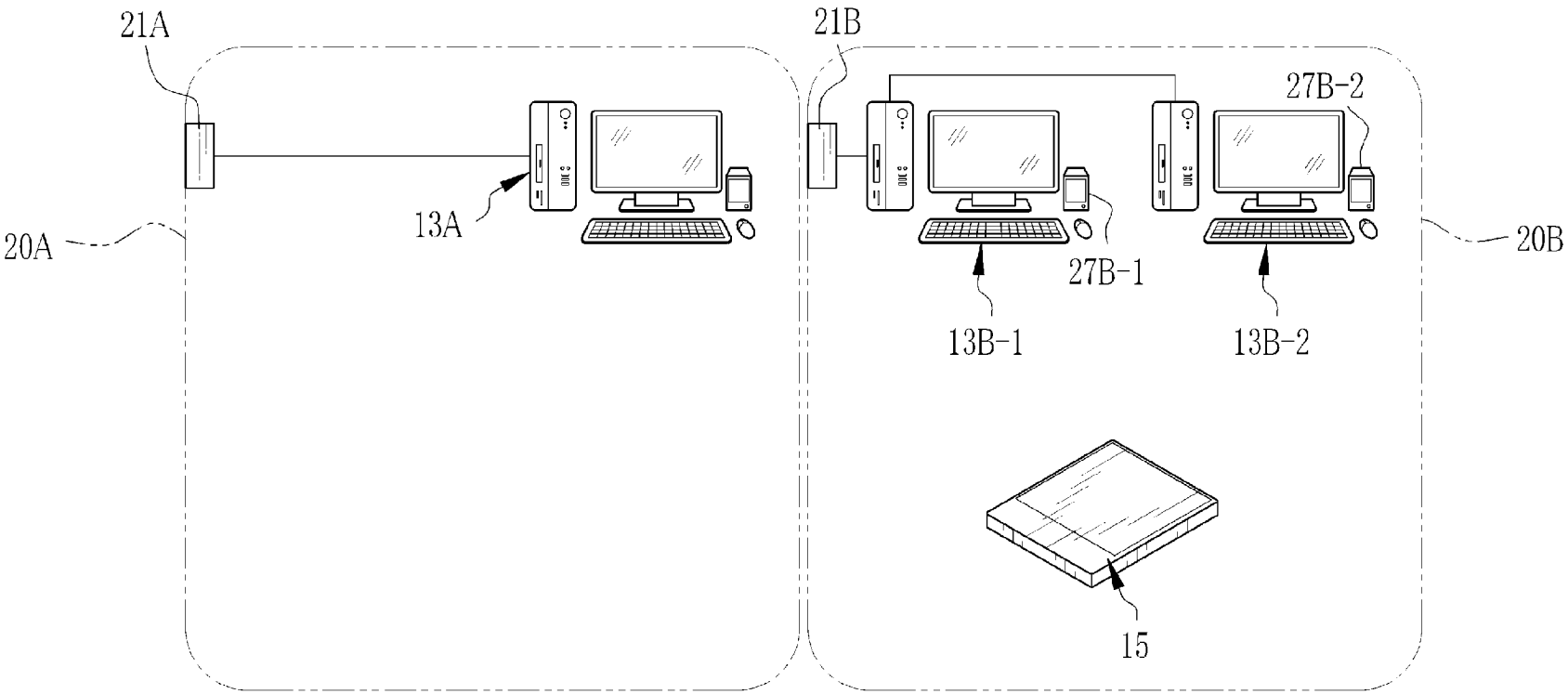
FIG. 22 is an explanatory diagram illustrating a situation wherein one service zone is supervised by a console, whereas another service zone is supervised by multiple consoles.

In the above embodiments, one service zone 20 is supervised by one console 13, like a first service zone 20A supervised by a first console 13A in FIG. 22, but one service zone 20 may be supervised by multiple consoles 13, like a second service zone 20B supervised by a couple of consoles 13B-1 and 13B-2.

In this case, the consoles 13B-1 and 13B-2 are interconnected. Data taking sections 80B-1 and 80B-2 of the consoles 13B-1 and 13B-2 take second detection results from a second wireless tag reader 21B and first detection results from a first wireless tag reader 21A as well. Alert controllers 81B-1 and 81B-2 of the consoles 13B-1 and 13B-2 operate in the same way as in the above first embodiment. Accordingly, when one electronic cassette 15 is moved out the second service zone 20B, speakers 27B-1 and 27B-2 of the consoles 13B-1 and 13B-2 sound an alarm. Recording controllers 90B-1 and 90B-2 of the consoles 13B-1 and 13B-2 individually record the current position of each cassette and store the tracking records.

Sixth Embodiment

In one service zone 20 which is supervised by multiple consoles 13, like the second 20B in FIG. 22, it may be bothering that all the speakers 27 of the multiple consoles 13 sound an alarm when one electronic cassette 15 has gone out said service zone 20. It would be sufficient to sound an alarm from one of the speakers 27 in one service zone 20. Furthermore, it would be sufficient to record the current positions and tracking records in one of the multiple consoles 13 for one service zone 20.

Therefore, according to the present embodiment, as shown in FIG. 23, in one service zone 20 which is supervised by multiple consoles 13, CPUs 71 of the multiple consoles 13 include a function of an enable/disable setting section 110 for designating one of the multiple consoles 13 as a master console of which the alert controller 81 and the recording controller 90 are enabled.

In this embodiment, the user R previously sets up one of the multiple consoles 13 as the master console through an input device 26 of the one console 13. Thereafter when the communication between these consoles 13 is established, the master console transmits a slave setting signal (refer to FIG. 24) to other consoles (hereinafter referred to as slave consoles), instructing the slave consoles to disable the alert controller 81 and the recording controller 90.

The data taking section 80 of each slave console receives the slave setting signal through a communicator section 72, and transfers the signal to the enable/disable setting section 110. The enable/disable setting section 110 disables the alert controller 81 and the recording controller 90 in response to the slave setting signal. Accordingly, the slave consoles do not give the alert from the speaker 27 or record the current position or make the tracking records by the recording controller 90. Meanwhile, the enable/disable setting section 110 of the master console enables the alert controller 81 and the recording controller 90. Thus, one master console takes charge of giving the alert from the speaker 27, recording the current position and making the tracking records, thereby resulting the problem of bothering alerts from multiple speakers 27.

If the multiple consoles 13 include a portable console, it is also possible to automatically assign the portable console as the master console regardless of the setting by the user R, so as to enable the alert controller 81 and the recording controller 90 of the portable console.

Figure 24:
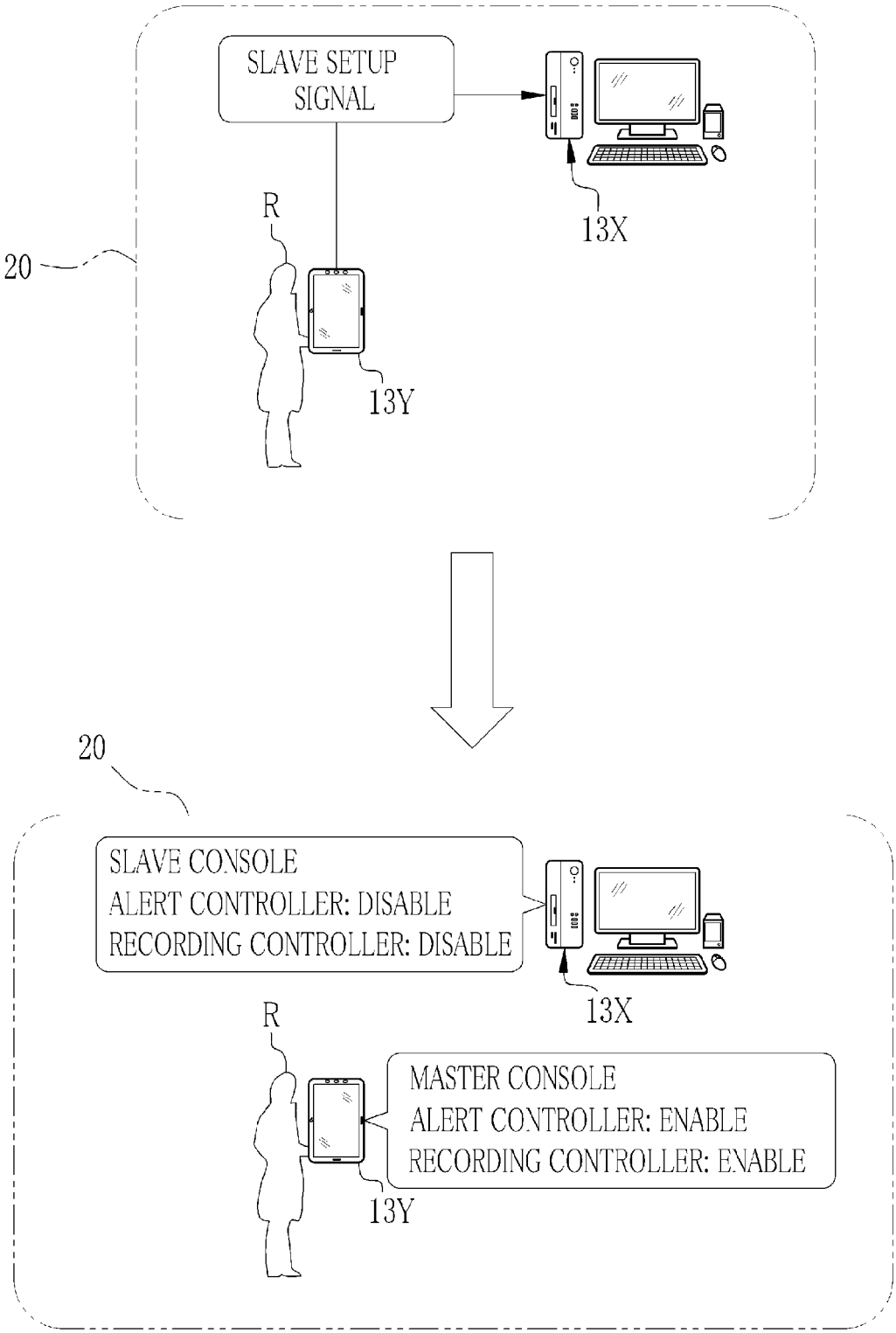
FIG. 24 is an explanatory diagram illustrating an example wherein a portable console is set up as a master console.

Specifically, as shown in FIG. 24, where one service zone 20 is supervised by a stationary console 13X and a portable console 13Y, the portable console 13Y automatically sends the stationary console 13X the slave setting signal when the communication between the stationary console 13X and portable console 13Y is established. Then, the stationary console 13X sends back a responding signal (not shown) to the portable console 13Y, acknowledging receipt of the slave setting signal.

Then, an enable/disable setting section 110X of the stationary console 13X disables an alert controller 81X and a recording controller 90X, to make the stationary console 13X function as a slave console. Meanwhile, an enable/disable setting section 110Y of the portable console 13Y enables an alert controller 81Y and a recording controller 90Y, to make the portable console 13Y function as a master console.

The portable console 13Y will be handled by the user R during the X-ray imaging, and is generally located closer to the user R than the stationary console 13X. Therefore, the user R can more easily be aware of the alert from the portable console 13X or refer to the current position and tracking records on the portable console 13X. Thus, it would be more convenient if the portable console 13Y is automatically designated as the master console.

Seventh Embodiment

Figures 25, 26:
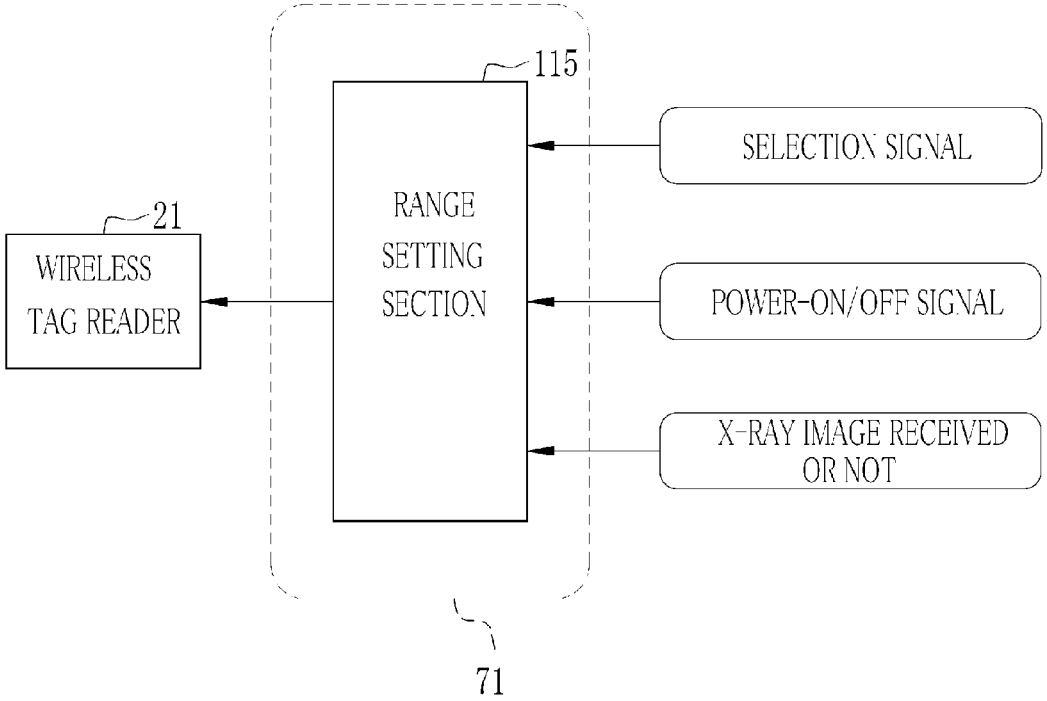
FIG. 25 is a block diagram illustrating functions of a CPU of a console, which is provided with a range setting section in accordance with a seventh embodiment.
FIG. 26 is a diagram illustrating a range setup table.

Although the range of each service zone 20 is fixed in the above embodiments, the present invention, as shown in FIG. 25, provide a CPU 71 of a console 13 with a range setting section 115 for setting the range of the range of an allocated service zone 20 according to the operational condition of the electronic cassette 15. The range setting section 115 modifies the range of the service zone 20 by changing the coverage (frequency band or wave intensity or both) of a search signal from a wireless tag reader 21. In the example in which the frequency band is changed to modify the range of the service zone 20, the wireless tags 50 of the electronic cassettes 15 should be configured to be compatible with multiple frequency bands.

The range setting section 115 determines the current operational condition of the electronic cassette 15 on the basis of various signals and information relating to the operational condition of the electronic cassette 15. The signals relating the operational condition of the electronic cassette 15 include the power-on and power-off signals and the selection signal. The information relating to the operational condition of the electronic cassette 15 include whether any X-ray image is received from the electronic cassette 15 or not.

In a period from when the communicator section 72 receives the power-off signal from the electronic cassette 15 to when the communicator section 72 thereafter receives the power-on signal from the electronic cassette 15 and sends back the selection signal to the electronic cassette 15, the range setting section 115 determines that the electronic cassette 15 is currently in the non-selected condition. After the communicator section 72 has sent back the selection signal to the electronic cassette 15, the range setting section 115 determines that the electronic cassette 15 is currently in the selected condition till when the communicator section 72 sends the selection signal to another electronic cassette or when the range setting section 115 determines that the electronic cassette 15 gets into the sleep mode. Whether the electronic cassette 15 gets into the sleep mode or not is determined by counting the time from when the communicator section 72 has sent the selection signal to the electronic cassette 15 and the time from when the communicator section 72 has received the X-ray image from the electronic cassette 15. The range setting section 115 determines that the electronic cassette 15 is in the sleep mode when no action relating to the electronic cassette 15 is newly made before the counted time reaches a predetermined length.

The range setting section 115 defines the range of the service zone 20 in accordance with a range setup table 116 shown in FIG. 26. The range setup table 116 show a relation between the operational condition of the electronic cassette 15 and the range of the service zone 20, and is stored in a storage device 28. The range of the service zone 20 is defined "5 m" in the case of the non-selected condition, and "2 m" in the case of the selected condition.

Because the electronic cassette 15 in the power-off mode will not be used in a short while, the user R does not usually pay attention to the electronic cassette 15 in the power-off condition. Therefore, especially for the sake of alerting the user R that the electronic cassette 15 is taken out by an unauthorized person, the range of the service zone 20 is set wider in the non-selected condition of the electronic cassette 15 than in the selected condition. Also for the electronic cassette 15 in the standby mode immediately after the power-on and in the sleep mode, as being not used soon, the range of the service zone 20 is set wider than in the selected condition.

Meanwhile, in the standby mode after the selection signal is received on the electronic cassette 15, while the user R is handling the electronic cassette 15, positioning the patient P and setting the imaging conditions, the electronic cassette 15 is under the supervision of the user R. Also in the ready mode of the electronic cassette 15, while the user R completes positioning the patient P and setting the imaging conditions and is ready to start imaging, as well as during the imaging, the electronic cassette 15 is under the supervision of the user R. Accordingly, it is not usually expected that the electronic cassette 15 is unrighteously taken out while the electronic cassette 15 is in the standby mode or the ready mode or taking the image. Therefore, the range of the service zone 20 is set narrower than in the non-selected condition.

Indeed the electronic cassette 15 might not usually be taken out of the service zone 20 while the electronic cassette 15 is in the standby mode or the ready mode or is taking an image, as the user R usually keeps an eye on the electronic cassette 15 under these circumstances, but there is a little possibility that the electronic cassette 15 will be stolen while the user R is busy setting for the image acquisition. To avoid this, the range of the service zone 20 is set to be 2 m for the selected condition of the electronic cassette 15.

By defining a narrower range of the service zone 20 for the electronic cassette 15 in the selected condition, while the electronic cassette 15 is selected to use for imaging, in comparison with the range of the service zone 20 for the non-selected condition while the electronic cassette 15 is not selected to use for imaging, the surveillance by the tag reader 21 ensures the security of the electronic cassette 15 while the user R does not pay attention to the electronic cassette 15, but the surveillance by the tag reader 21 is limited to the minimum range while the electronic cassette 15 is under the supervision of the user R. The narrower range of the service zone 20 for the selected condition makes it possible to alert the user R to the theft of the electronic cassette 15 quickly before the electronic cassette 15 is taken out of eyeshot of the user R.

The range of the service zone 20 may be defined more finely, as shown for example in a range setup table 117 in FIG. 28, wherein the range of the service zone 20 is narrowed to 3 m for the sleep mode as compared to the range of 5 m for the power-off condition among those for the non-selected condition, and the range of the service zone 20 is narrowed to 1 m for the ready mode as compared to the range of 2 m for the standby mode immediately after the receipt of the selection signal among those for the selected condition.

The feature of "narrowing the range of the service zone 20" includes setting the range of the service zone 20 to be zero meter, that is, not-executing the detection of passage of the electronic cassette 15 into and out of said service zone 20. In this case, the console 13 is configured to control the power of the tag reader 21 on and off, so that the range of the service zone 20 is set to be 0 m by turning the power of the tag reader 21 off. Alternatively, the data taking section 80 may discard the detection results from the tag reader 21, to thereby set the range of the service zone 20 to be virtually 0 m. It is possible to define the range of the service zone 20 to be 0 m while the electronic cassette 15 is in the selected condition because the electronic cassette 15 in the selected condition is under the supervision of the user R and would not usually taken out.

As the method for defining the range of the service zone 20, it is possible to provide different kinds of wireless tag readers 21 each having a different transmission range of the search signal such that the range setting section 115 switches over these wireless tag readers 21 to change the range of the service zone 20.

Narrowing the range of the service zone 20 in the manner as described above would cause no problem while there is only one electronic cassette 15 in the service zone 20. However, if another electronic cassette 15 that is not used for imaging exists in the same service zone as the electronic cassette 15 to be used for imaging, the other electronic cassette can be excluded from the coverage of the wireless tag reader 21 when the range of the service zone 20 is narrowed according to the condition of the electronic cassette 15 to be used for imaging. This is a problem because no alert would be given if the other electronic cassette 15 should be taken out. To avoid this problem, it is preferable to allow the range setting section 115 to narrow the range of the service zone 20 only while there is a single electronic cassette 15 in the service zone 20, and interrupt narrowing the range of the service zone 20 if there is another electronic cassette 15 in the same service zone besides the electronic cassette 15 selected for imaging.

In a case where there are multiple electronic cassettes 15 in one service zone 20 and one of these electronic cassettes 15 is in the selected condition, it is not a problem if one electronic cassette 15 that is not selected is taken out for a proper purpose. Therefore, under these circumstances, it may be preferable to define a wider range of the service zone 20 than usual in order to monitor unauthorized takeout of the electronic cassettes 15 while permitting authorized transportation of the electronic cassettes 15 within a proper operational range.

Although examples where applicable electronic cassettes 15 are previously registered in the console 13 have been described in the above embodiments, the previous registration of the electronic cassettes 15 in the console 13 is not essential to the present invention. However, it is preferable to register the electronic cassettes 15 previously in the console 13 because it allows determining which of these cassettes should be supervised or not.

In the above embodiments, a wireless tag reader 21 which receives the radio frequency signal s from wireless tags 50 on electronic cassettes 15 is referred to as a wireless receiver which constitutes the detector section for detecting passage of the electronic cassettes 15 into and out of each service zone 20. The detector section may also be a wireless LAN access point. In this case, the wireless LAN access point communicates signals with a wireless LAN interface that constitutes a wireless transmitter provided in each electronic cassette 15, to thereby detect passage of the electronic cassette 15 into and out of each service zone 20.

As another example of the detector section, a surveillance camera may be used besides the wireless receiver. In the example where the surveillance camera is used as the detector section, the come and go of the electronic cassettes 15 is detected by analyzing images captured by the surveillance camera. In this case, the imaging field of the surveillance camera constitutes the service zone 20. Alternatively, in place of the wireless receiver or the surveillance camera, a sensor for detecting passage of the electronic cassettes 15 may be disposed at the doorway 6 or the staff entrance 8.

Furthermore, a detector section (a wireless receiver), a data taking section and an alert controller may be provided in the electronic cassette 15. In this case, for example, a sender for sending radio frequency signal s is disposed at the doorway 6 or on the door of the staff entrance 8, so that the radio frequency signal is received on the detector section of the electronic cassette 15. When it is determined that the radio frequency signal is not received on the detector section, the alert controller determines that the electronic cassette 15 has gone out the service zone 20, and controls a speaker of the electronic cassette 15 or other device to give an alert. Thereafter when the detector section begins to receive the radio frequency signal again, the alert controller determines that the electronic cassette 15 returns to the service zone 20 and stops the alert. The detection results obtained by the detector section may be transmitted from the electronic cassette 15 to a console 13 that supervises the service zone 20 in which the electronic cassette 15 has been present and then from said console 13 to other consoles 13 that supervise other service zones 20, at the moment when the electronic cassette 15 is moved out and hence the detector section cannot receive the radio frequency signal, or at the moment when the detector section begins to receive the radio frequency signal again as the electronic cassette 15 is moved back to the service zone 20. The detection result should be transmitted in accordance with a different communication protocol from that applied to the radio frequency signal for the detector section.

In the above embodiments, the consoles 13 that supervise respective service zones 20 individually take on the functions of the electronic cassette management device. In an alternative, as shown for example in FIG. 29, a computer other than the consoles 13 may serve as an electronic cassette management device.

Figure 29:
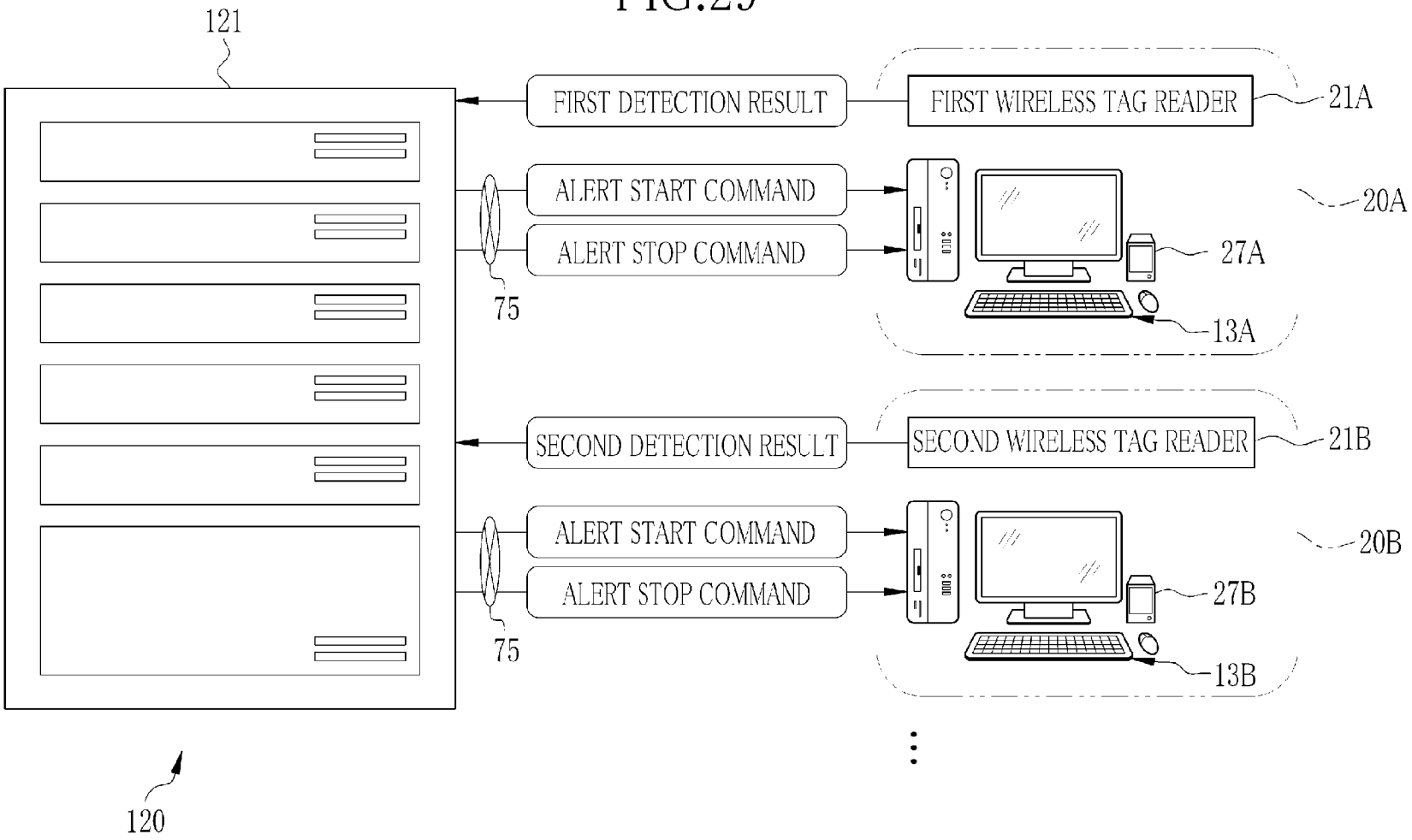
FIG. 29 is a diagram illustrating an electronic cassette management system in accordance with another embodiment of the present invention.

In FIG. 29, an electronic cassette management system 120 is constituted of an electronic cassette management device 121, and a first wireless tag reader 21A, a second wireless tag reader 21B, . . . for supervising passage of electronic cassettes 15 into and out of a first service zone 20A, a second service zone 20B, . . . , respectively. The wireless tag readers 21A, 21B, . . . are connected to the electronic cassette management device 121. Furthermore, the service zones 20A, 20B, . . . are supervised by a first console 13A, a second console 13B, . . . , respectively, and the consoles 13A, 13B, . . . and the electronic cassette management device 121 are interconnected through a network 75.

A CPU of the computer that constitutes the electronic cassette management device 121 functions as a data taking section for taking the first, the second, . . . detection results from the respective wireless tag readers 21A, 21B, . . . , and as an alert controller that outputs an alert start command to at least one of the consoles 13 when the alert controller determines that one of the electronic cassettes 15 is moved out of any of the service zones 20A, 20B, . . . , to thereby cause at least a speaker 27 to start warning. When the alert controller determines that the one electronic cassette 15 is moved into any of the service zones 20A, 20B, . . . after the alert starts, the alert controller outputs an alert stop command to the console 13 to stop the alert by the speaker 27.

In this configuration, a controller for recording the current position and tracking records is established in the CPU of the computer that constitutes the electronic cassette management device 121, the current position and tracking records are stored in a storage device of the electronic cassette management device 12. The electronic cassette management device 121 transmits the current position and tracking records from the storage device to the console 13 in response to a request from the console 13 for the current position and tracking records. The CPU of the computer that constitutes the console 13 serves as a display controller, and the display controller controls the display device 25 to display the current position window 93 or the current position and tracking record window 96 on the basis of the current position and tracking records from the electronic cassette management device 121. Thus, the electronic cassette management device 121 of the present invention may be functionally divided into a plurality of computers, or integrated into a computer.

In this example, the home position setting section, the enable/disable setting section and the range setting section are established in the CPU of the computer that constitutes the electronic cassette management device 121.

Establishing the functions of the electronic cassette management device integrally in one computer, not in the individual consoles 13 for supervising the individual service zones 20, will save the time for installing the electronic cassette management program 74 in the individual consoles 13.

The present invention is applicable to a case where there is only one electronic cassette 15. Furthermore, the wireless tag 50 may also be an active tag that has an integrated power supply and generates a radio frequency signal by itself. Moreover, in place of the wireless tag reader 21, a wireless tag reader/writer having a function of writing information may be used. The wireless tag reader/writer makes it possible to write the current position and tracking records in the wireless tag 50.

It is to be noted that the present invention may be embodied as a program, as set forth above with reference to the above embodiments, and includes a storage medium storing the program in the scope. Furthermore, the present invention is not to be limited to the above embodiments, but various modifications are possible without departing from the gist of the present invention. For example, the above embodiments may be implemented individually or in combination.

What is claimed is:

1. An electronic cassette management system comprising:

first and second detectors for detecting the come and go of an electronic cassette with respect to at least first and second predetermined service zones;

a data taking section for taking detection results from the first and second detectors; and an alert controller which starts an alert when the alert controller determines, on the basis of detection results taken by the data taking section, that the electronic cassette has gone out either of the first and second service zones, and stops the alert when the alert controller determines, on the basis of detection results taken by the data taking section after the start of alerting, that the electronic cassette has come in either of the first and second service zones.

2. The electronic cassette management system of claim 1, further comprising a recording controller for recording a current position of the electronic cassette, which is determined by the detection results, in a recording section.

3. The electronic cassette management system of claim 2, wherein the recording controller records tracking records in the recording section in addition to the current position, tracking records indicating former positions of the electronic cassette, which have been determined by former detection results taken by the data taking section.

4. The electronic cassette management system of claim 3, further comprising a display controller for displaying at least the current position on a display among the current position and the tracking records.

5. The electronic cassette management system of claim 3, further comprising a home position setting section for setting up a home position of the electronic cassette.

6. The electronic cassette management system of claim 5, wherein the recording controller deletes at least part of the tracking records when the electronic cassette comes back to the home position that is set up by the home position setting section.

7. The electronic cassette management system of claim 5, wherein the home position setting section refers to the tracking records to set up a place as the home position where the electronic cassette is frequently located.

8. The electronic cassette management system of claim 2, wherein the data taking section, the alert controller and the recording controller are provided in a console that is provided for operating the electronic cassette.

9. The electronic cassette management system of claim 8, wherein one of the service zones is supervised by a plurality of consoles, and the electronic cassette management system further comprises an enable/disable setting section for enabling the alert controller and the recording controller in at least one of the plurality of consoles.

10. The electronic cassette management system of claim 9, wherein the plurality of consoles include a portable console that a user of the electronic cassette is carried about, and the enable/disable setting section enables the alert controller and the recording controller of the portable console.

11. The electronic cassette management system of claim 1, further comprising a range setting section for setting up the range of the service zone according to operational conditions of the electronic cassette.

12. The electronic cassette management system of claim 11, wherein the operational conditions include a non-selected condition in which the electronic cassette is not selected to use for radiography and a selected condition selected to use for radiography, and the range setting section sets the range of the service zone narrower in the selected condition than in the non-selected condition.

13. The electronic cassette management system of claim 1, wherein a plurality of electronic cassettes can be registered as ones to be detected by the detectors.

14. The electronic cassette management system of claim 1, wherein the detectors are wireless receivers that a receive radio frequency signal from a wireless communicator section provided in the electronic cassette.

15. A method for operating an electronic cassette management system comprising the steps of:

detecting the come and go of an electronic cassette by first and second detectors with respect to at least first and second predetermined service zones;

taking detection results from the first and second detectors;

starting an alert when it is determined on the basis of the detection results that the electronic cassette has gone out either of the first and second service zones; and stopping the alert when it is determined that the electronic cassette has come in either of the first and second service zones on the basis of detection results taken from the first and second detectors after the start of alerting.

16. An electronic cassette management device comprising:

a first detector for detecting the come and go of an electronic cassette with respect to a predetermined first service zone;

a data taking section for taking first detection results from the first detector and second detection results from a second detector for detecting the come and go of the electronic cassette with respect to a second service zone that is assigned to at least another electronic cassette management device; and an alert controller that starts an alert when the alert controller determines, on the basis of the first detection results taken by the data taking section, that the electronic cassette has gone out the first service zone, and stops the alert when the alert controller determines, on the basis of the first detection results or the second detection results taken by the data taking section, that the electronic cassette has come in the first service zone or the second service zone.

* * * * *